US007040963B1

(12) United States Patent
Okuda et al.

(10) Patent No.: US 7,040,963 B1
(45) Date of Patent: May 9, 2006

(54) TABLE OF WAFER POLISHING APPARATUS, METHOD FOR POLISHING SEMICONDUCTOR WAFER, AND METHOD FOR MANUFACTURING SEMICONDUCTOR WAFER

(75) Inventors: Yuji Okuda, Gifu (JP); Naoyuki Jimbo, Gifu (JP); Kazutaka Majima, Gifu (JP); Masahiro Tsuji, Gifu (JP); Hideki Takagi, Gifu (JP); Shigeharu Ishikawa, Gifu (JP); Hiroyuki Yasuda, Gifu (JP)

(73) Assignee: Ibiden Co., Ltd., Gifu (JP)

( * ) Notice: Subject to any disclaimer, the term of this patent is extended or adjusted under 35 U.S.C. 154(b) by 370 days.

(21) Appl. No.: 10/018,708

(22) PCT Filed: Jun. 15, 2000

(86) PCT No.: PCT/JP00/03899

§ 371 (c)(1),
(2), (4) Date: Apr. 15, 2002

(87) PCT Pub. No.: WO00/76723

PCT Pub. Date: Dec. 21, 2000

(30) Foreign Application Priority Data

| | | |
|---|---|---|
| Jun. 15, 1999 | (JP) | 11/168522 |
| Jun. 15, 1999 | (JP) | 11/168523 |
| Jun. 30, 1999 | (JP) | 11/185333 |
| Aug. 24, 1999 | (JP) | 11-237507 |
| Aug. 24, 1999 | (JP) | 11-237508 |
| Aug. 24, 1999 | (JP) | 11-237509 |
| Aug. 26, 1999 | (JP) | 11-239900 |
| Sep. 29, 1999 | (JP) | 11-277117 |
| Sep. 29, 1999 | (JP) | 11-277118 |

(51) Int. Cl.
*B24B 1/00* (2006.01)

(52) U.S. Cl. ..... 451/41; 451/28

(58) Field of Classification Search ..... 457/41, 457/28, 285–289, 526, 533, 537, 550, 53, 457/65

See application file for complete search history.

(56) References Cited

U.S. PATENT DOCUMENTS

| | | | | |
|---|---|---|---|---|
| 4,552,122 | A | 11/1985 | Kelly | |
| 5,256,599 | A | 10/1993 | Asetta et al. | |
| 5,454,750 | A * | 10/1995 | Cosmano et al. | 451/526 |
| 5,664,989 | A * | 9/1997 | Nakata et al. | 451/41 |
| 6,220,942 | B1 * | 4/2001 | Tolles et al. | 451/65 |
| 2003/0008598 | A1 * | 1/2003 | Jimbo et al. | 451/38 |

FOREIGN PATENT DOCUMENTS

| | | |
|---|---|---|
| EP | 0860238 A2 | 8/1998 |
| JP | 09150351 | 6/1997 |
| JP | 10235552 | 9/1998 |
| JP | 11090814 | 4/1999 |

* cited by examiner

*Primary Examiner*—Lee D. Wilson
(74) *Attorney, Agent, or Firm*—Sawyer Law Group LLP

(57) ABSTRACT

A table for a wafer polishing apparatus having superior heat-resistant, anti-thermal-shock, and anti-abrasion characteristics and capable of increasing the diameter of a semiconductor wafer while improving the quality of the wafer. The table (2) includes a plurality of superimposed bases (11) each of which is formed of silicide ceramic or carbide ceramic. The bases (11) are joined together by an adhesive layer (14). A fluid passage (12) is formed in a joining interface between the bases (11).

37 Claims, 11 Drawing Sheets

(b)

TABLE OF WAFER POLISHING APPARATUS, METHOD FOR POLISHING SEMICONDUCTOR WAFER, AND METHOD FOR MANUFACTURING SEMICONDUCTOR WAFER

The present invention relates to a table of a semiconductor wafer polishing apparatus, a method for polishing semiconductor wafers with the polishing apparatus, and a method for manufacturing a semiconductor wafer with the polishing apparatus.

BACKGROUND OF THE INVENTION

These days, most electric products employ a semiconductor device that includes a fine conductive circuit formed on a silicone chip. Generally, the semiconductor device is fabricated using a monocrystal silicon ingot as a starting material in accordance with the following procedure.

First, the ingot is sliced into thin pieces. The pieces are then polished in a lapping step and a polishing step to obtain bare wafers. The bare wafers include mirror surfaces and are thus referred to as mirror wafers. Also, if the bare wafers are obtained in an epitaxial growth layer forming step after the lapping step and before the polishing step, the bare wafers are particularly referred to as epitaxial wafers.

In a subsequent wafer treating step, the bare wafers are repeatedly subjected to oxidation, etching, and impurity diffusion. Afterwards, the bare wafers are cut into an appropriate size in a dicing step. This finally completes a desired semiconductor device.

In these steps, a device forming side of each semiconductor wafer needs be polished with a certain means. As an effective polishing means, various types of wafer polishing apparatuses (including lapping machines and polishing machines) have been proposed.

A typical wafer polishing apparatus includes a table, a pusher plate, and a cooling jacket. The table is secured to an upper portion of the cooling jacket. The table and the cooling jacket are formed of metal such as stainless steel. A passage is formed in the cooling jacket and coolant water for cooling the table circulates in the passage. The pusher plate is located above the table and has a holding side (a lower side) to which a wafer subject to polishing is adhered by a thermoplastic wax. The pusher plate rotates to press the wafer, which is held by the pusher plate, against a polishing side (an upper side) of the table from above. The wafer thus contacts the polishing side, and one side of the wafer is uniformly polished. During polishing, heat is generated on the wafer and is transmitted to the cooling jacket through the table. The coolant water that circulates in the passage of the cooling jacket releases the heat from the apparatus.

The table of the wafer polishing apparatus is often heated to a high temperature when polishing is performed. It is thus required that the table be formed of a heat-resistant and thermal-shock-resistant materials. Further, frictional force constantly acts on the polishing side of the table. It is thus required that the material of the table need be resistant to abrasive wear. In addition, generation of thermal stress that bends the wafer must be avoided to increase the wafer diameter and improve the wafer quality. It is thus necessary to minimize temperature differences in the table. Accordingly, the material of the table needs to have high heat conductivity.

BRIEF SUMMARY OF THE INVENTION

It is an objective of the present invention to provide a table of a wafer polishing apparatus that has superior heat-resistant, thermal-shock-resistant, and anti-abrasion characteristics and is capable of increasing the diameter of a semiconductor wafer while improving the wafer quality.

It is another objective of the present invention to provide a method for polishing semiconductor wafers and a method for manufacturing the semiconductor wafers that are optimal for uniformly polishing the semiconductor wafers to increase the wafer diameter and improve the wafer quality.

To solve the above-described problems in accordance with the objectives of the present invention, an improved table of a wafer polishing apparatus is provided. The table has a polishing surface for polishing a semiconductor wafer held by a wafer holding plate of the wafer polishing apparatus. The table includes a plurality of superimposed bases, each base being formed from silicide ceramic or carbide ceramic. At least one of the bases has a fluid passage formed in its superimposition interface.

In a second perspective of the present invention, the table includes a plurality of superimposed bases, each base being formed from a silicon carbide sinter. At least one of the bases has a fluid passage formed in its superimposition interface.

A third perspective of the present invention is a table having a polishing surface for polishing a semiconductor wafer held by a wafer holding plate of a wafer polishing apparatus. The table is formed of a material, the Young's modulus of which is 1.0 $kg/cm^2(\times 10^6)$ or greater.

A fourth perspective of the present invention provides a method for performing polishing using a table having a polishing surface for polishing a semiconductor wafer held by a wafer holding plate of a wafer polishing apparatus. The table includes a plurality of superimposed bases, each base being formed from silicide ceramic or carbide ceramic. At least one of the bases has a fluid passage formed in its superimposition interface. The method includes the steps of rotating the semiconductor wafer, and contacting the semiconductor wafer with the polishing surface of the table while circulating coolant water in the fluid passage.

A fifth perspective of the present invention provides a method for manufacturing a semiconductor wafer. The method includes performing polishing using a table having a polishing surface for polishing a semiconductor wafer held by a wafer holding plate of a wafer polishing apparatus. The table includes a plurality of superimposed bases, each base being formed from silicide ceramic or carbide ceramic. At least one of the bases has a fluid passage formed in its superimposition interface. The polishing step includes the steps of rotating the semiconductor wafer, and contacting the semiconductor wafer with the polishing surface of the table while circulating coolant water in the fluid passage.

A sixth perspective of the present invention is a method for manufacturing a table having a polishing surface for polishing a semiconductor wafer held by a wafer holding plate of a wafer polishing apparatus. The method includes the steps of arranging a foil-like brazing filler between a plurality of bases, each having a groove formed in its surface and each formed from a silicon carbide sinter, and heating each of the bases to braze the bases together.

DETAILED DESCRIPTION OF THE PREFERRED EMBODIMENTS

First Embodiment

Figure 1:
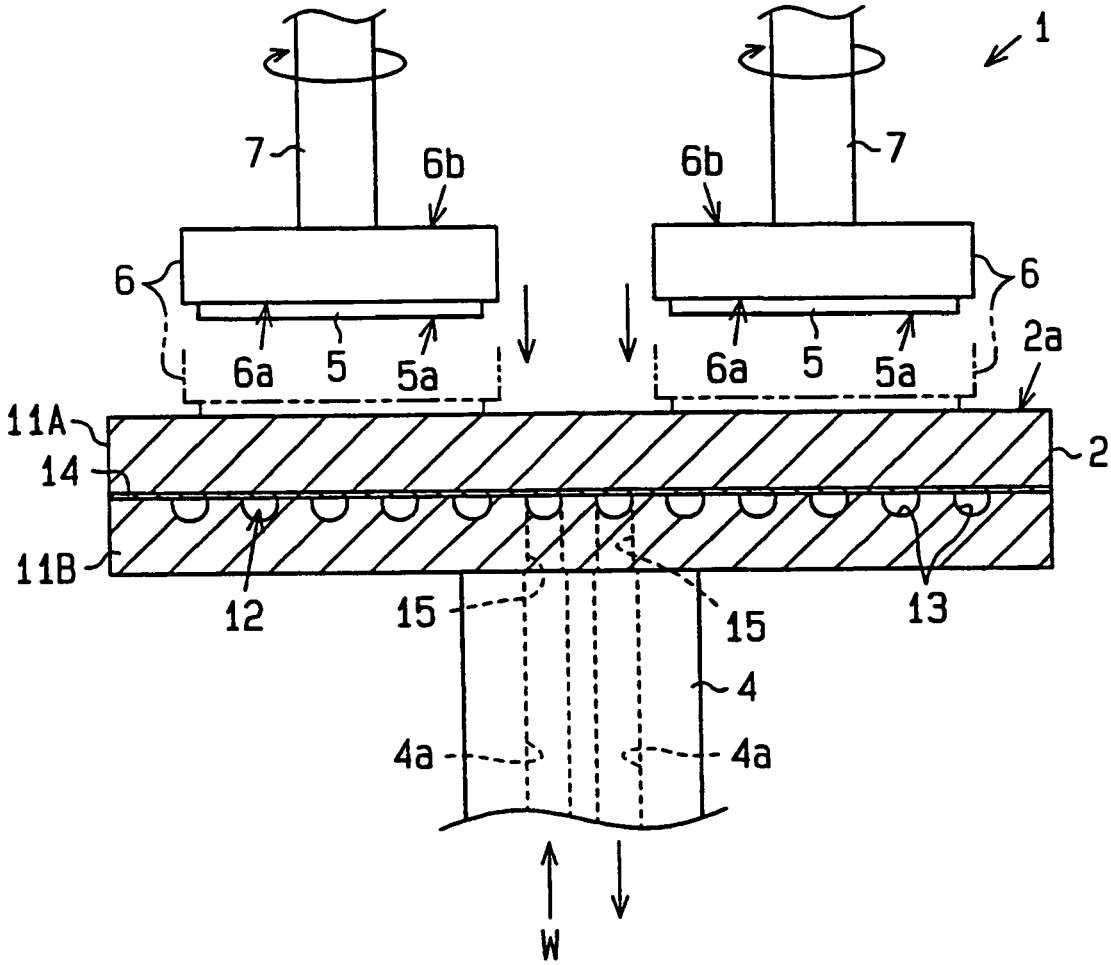
FIG. 1 is a view schematically showing a wafer polishing apparatus of a first embodiment according to the present invention.

A wafer polishing apparatus 1 of the first embodiment will now be described in detail with reference to FIGS. 1 and 2. FIG. 1 schematically shows the wafer polishing apparatus 1 of the first embodiment. The wafer polishing apparatus 1 includes a disk-like table 2. A polishing surface 2*a*, on which a semiconductor wafer 5 is polished, is defined on the upper side of the table 2. A polishing cloth (not shown) is applied to the polishing surface 2*a*. In the first embodiment, a cooling jacket is not employed, and the table 2 is horizontally and directly secured to an upper end of a cylindrical rotary shaft 4. Thus, when the rotary shaft 4 is rotated, the table 2 rotates integrally with the rotary shaft 4.

As shown in FIG. 1, the wafer polishing apparatus 1 includes a plurality of wafer holding plates 6 (for the sake of brevity, only two are shown in FIG. 1). Each plate 6 is formed of, for example, glass, ceramic such as alumina, or metal such as stainless steel. A pusher rod 7 is fixed to a middle portion of one side (a non-holding side 6*b*) of each wafer holding plate 6. Each pusher rod 7 is located above the table 2 and is connected to a drive means (not shown). Each pusher rod 7 horizontally supports the associated wafer holding plate 6. In this state, the holding sides 6*a* oppose the polishing surface 2*a* of the table 2. Further, each pusher rod 7 rotates integrally with the associated wafer holding plate 6 and moves upward and downward in a predetermined range. In addition to the upward or downward movement of the plates 6, the table 2 may be configured to move upward or downward. A semiconductor wafer 5 is adhered to the holding surface 6*a* of each wafer holding plate 6 by an adhesive agent such as thermoplastic wax. The semiconductor wafers 5 may be vacuumed or electrostatically attracted to the corresponding holding sides 6*a*. In this state, a polished surface 5*a* of each semiconductor wafer 5 must be faced toward the polishing surface 2*a* of the table 2.

If the apparatus 1 is used as a lapping machine, or is used for polishing the semiconductor wafers 5 after a slicing step of a bare wafer process is completed, it is preferred that the wafer holding plates 6 be configured as follows. That is, it is preferred that each plate 6 allow the corresponding semiconductor wafer 5 to contact the polishing surface 2*a* in a state in which a predetermined pressure is applied to the polishing surface 2*a*. This is possible since the wafer 5 does not include an epitaxial growth layer, which the wafer holding plate 6 (the pusher plate) would remove from the wafer 5 when applying pressure. It is preferred that the wafer holding plates 6 be configured in the same manner if the apparatus 1 is used as a polishing machine for manufacturing mirror wafers, or is used for polishing the semiconductor wafers 5 without performing an epitaxial growth step after the lapping step is completed.

If the apparatus 1 is used as a polishing machine for manufacturing epitaxial wafers, or is used for polishing the semiconductor wafers 5 that have been subjected to the epitaxial growth step after the lapping step, it is preferred that the plates 6 be configured as follows. That is, it is preferred that each plate 6 have the corresponding semiconductor wafer 5 contact the polishing surface 2*a* while applying substantially no pressure to the polishing surface 2*a*. This is because a silicone epitaxial growth layer easily separates compared to monocrystal silicon. It is preferred that the wafer holding plates 6 be configured basically in the same manner if the apparatus 1 is used as a machine for performing chemical mechanical polishing (CMP) after various layer forming steps.

The structure of the table 2 will hereafter be described in detail.

Figure 2:
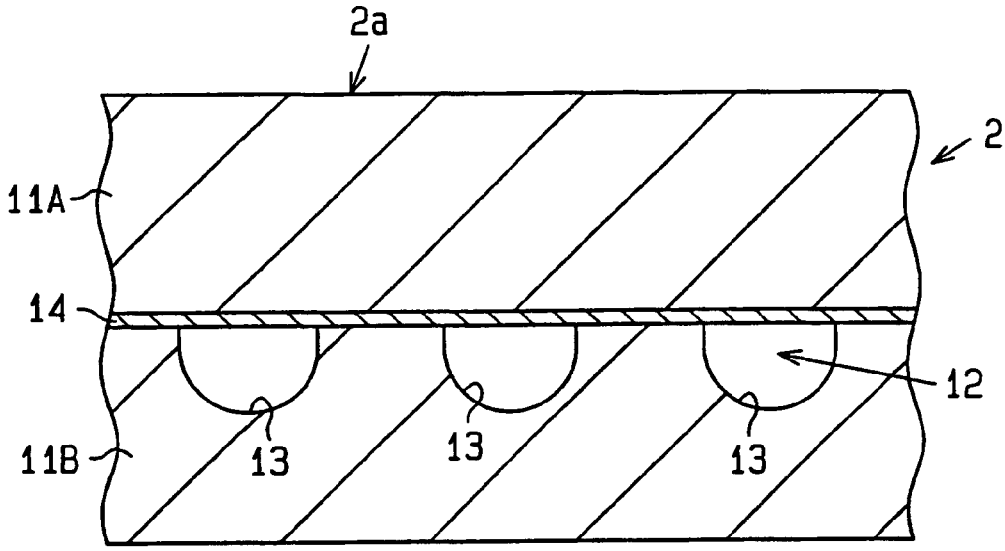
FIG. 2 is an enlarged cross-sectional view showing a main portion of a table used in the apparatus of FIG. 1.

As shown in FIGS. 1 and 2, the table 2 of the first embodiment is a superimposed ceramic body that includes a plurality of (in this embodiment, two) superimposed bases 11A, 11B. Among the two bases 11A, 11B, grooves 13 having a predetermined pattern are formed in the upper side of the lower base (hereafter, the lower base 11B). The bases 11A, 11B are joined together by a brazing filler layer 14, or a non-organic adhering material layer, thus forming an integral body. Accordingly, a coolant water passage 12, or a fluid passage, is formed in the joining interface between the bases 11A, 11B. That is, the grooves 13 form part of the coolant water passage 12. A plurality of through holes 15 are formed in the middle of the lower base 11B. The through holes 15 connect a passage 4*a* formed in the rotary shaft 4 to the coolant water passage 12.

Each base 11A, 11B is formed from a ceramic material. It is preferred that the material be ceramic silicide or ceramic carbide. Particularly, in the first embodiment, the ceramic material is a dense body that is formed from a silicon carbide sinter (SiC sinter), the starting material of which is silicon carbide powder. The dense body has strongly bonded crystal particles and an extremely small number of pores. The dense body is thus suitable as the material of the table. Further, compared to other ceramic sinters, the silicon carbide sinter, the starting material of which is silicon carbide powder, includes particularly superior heat conductivity, heat-resistant performance, anti-thermal-shock performance, and anti-abrasion performance characteristics. In the first embodiment, the two bases 11A, 11B are formed from the same material.

The silicon carbide powder includes a type silicon carbide powder, β type silicon carbide powder, and amorphous silicon carbide powder. In this case, one type of powder may be solely employed. Alternatively, two or more types of powders may be combined (α type+β type, a type+amorphous type, β type+amorphous type, or a type+β type+amorphous type). A sintered formed from β type silicon carbide powder includes a large number of large plate crystals compared to sinters of other types of silicon carbide powders. Thus, the sinter formed from β type silicon carbide powder includes a relatively small number of grain boundaries in the crystal particles of the sinter and has particularly superior heat conductivity.

The density of the bases 11A, 11B is preferred to be 2.7 $g/cm^3$ or greater, is more preferred to be 3.0 $g/cm^3$ or greater, and is especially preferred to be 3.1 $g/cm^3$ or greater. If the density is excessively low, the bonding among the crystal particles of the sintered body is weakened and the number of the pores increases. This results in the bases 11A, 11B having unsatisfactory anti-corrosion and anti-abrasion characteristics.

It is preferred that the heat conductivity of each base 11A, 11B be 30 W/m·K or greater and more preferred that the heat conductivity be 80 W/m·K to 200 W/m·K. If the heat conductivity is excessively low, there is a tendency of temperature differences being produced in the sinter, thus hampering the increasing of the diameter of the semiconductor wafers 5 and improvement of the wafer quality. On the other hand, although the heat conductivity is preferred to be higher, it becomes difficult to procure materials inexpensively and stably when the heat conductivity exceeds 200 W/m·K.

The groove 13, which forms part of the coolant water passage 12, is a grounded groove, or is formed by grinding the upper side of the lower base 11B with a grinder. The groove 13 does not necessarily have to be ground but may be formed through, for example, blasting such as sand blasting. As schematically shown in FIG. 2, the groove 13, which is formed through these processes, has a relatively round cross-sectional shape. It is preferred that the depth of the groove 13 be approximately 3–10 millimeters and that the width of the groove 13 be approximately 5–20 millimeters.

A procedure for fabricating the table 2 will hereafter be briefly described.

First, a small amount of sintering aiding agent is added to silicon carbide powder and uniformly mixed. Boron, boron compound, aluminum, aluminum compound, or carbon is selected as the sintering aiding agent. The addition of the small amount of the sintering aiding agent increases the crystal growth speed of silicon carbide such that a resulting sinter is dense and has high heat conductivity.

Next, the mixture is molded into disk-like molded products. The bodies are then calcinated at 1800 to 2400 degrees Celsius to obtain the two bases 11A, 11B, each of which is a silicon carbide sinter. If the calcinating temperature is too low, not only does it become difficult to increase the crystal particle diameter but also a large number of pores are formed in the sintered body. In contract, if the calcinating temperature is too high, silicon carbide starts to decompose and lowers the strength of the sintered body.

Subsequently, one side of the lower base 11B is substantially entirely ground with a grinder to form the grooves 13, which have a predetermined width and a predetermined depth. Further, after applying the brazing filler to on one side of the upper base 11A, the two bases 11A, 11B are superimposed to arrange the brazing filler layer 14 and the groove 13 in the interface between the bases 11A, 11B. In this state, the bases 11A, 11B are heated to the melting temperature of the brazing filler, thus brazing the bases 11A, 11B together. Finally, the upper side of the upper base 11A is polished to form the polishing surface 2*a*. The surface polishing step may be performed before the adhesion step or the groove formation step. The table 2 of the first embodiment is thus formed in the above-described procedure.

The following are referential examples of the first embodiment.

Referential Example 1-1

In referential example 1-1, "beta random (trade name)", product of IBIDEN KABUSHIKI KAISHA, was used as silicon carbide powder that contained 94.6 weight percent of β type crystals. The average crystal particle diameter of this powder was 1.3 micrometers. The powder contained 1.5 weight percent of boron and 3.6 weight percent of free carbon.

First, 5 weight parts of polyvinyl alcohol and 300 weight parts of water were added to 100 weight parts of the silicon carbide powder. The mixture was then stirred in a ball mill for five hours to obtain a uniform mixture. The mixture was dried for a predetermined time to remove a certain amount of moisture from the mixture. An appropriate amount of the dry mixture was then sampled and granulated. Next, the granules of the dry mixture were subjected to molding with metal press dies at a pressure of 50 $kg/cm^2$. The density of the resulting molded body was 1.2 $g/cm^3$.

Subsequently, the molded body was placed in a graphite crucible sealed from ambient air. The body was then calcinated using a Tammann type calcinating furnace. The calcination was performed in an argon gas atmosphere of one atmospheric pressure. During the calcination, the heating was increased at a rate of 10 degrees Celsius per minute until reaching a maximum temperature of 2300 degrees Celsius. The maximum temperature was maintained for two hours. The observation of the resulting bases 11A, 11B indicated an extremely dense, three-dimensional network structure in which plate crystals were entangled in multiple directions. Further, the density of each base 11A, 11B was 3.1 $g/cm^3$. The heat conductivity of each base 11A, 11B was 150 W/m·K. Each base 11A, 11B contained 0.4 weight percent of boron and 1.8 weight percent of free carbon.

Afterwards, the grooves 13 were ground to a depth of 5 millimeters and a width of 10 millimeters. The two bases 11A, 11B were then integrally brazed to each other. The thickness of the brazing filler layer 14 was about 20 micrometers. Further, the upper side of the upper base 11A was polished to form the table 2 that had the polishing surface 2*a*.

The resulting table 2 of referential example 1-1 was installed in the aforementioned various types of apparatuses 1. The semiconductor wafers 5 of different dimensions were then polished with the apparatuses 1, while the coolant water W was constantly circulating. As a result, regardless of the type of the apparatus 1, thermal deformations were not found in the table 2. Further, cracks were not found in the brazing filler layer 14, and a high bonding strength was maintained in the joining interface between the bases 11A, 11B. Also, a breakage test was conducted on the table 2 using a conventional method that complies with JIS R 1624 to measure the flexural strength of the interface. The value was approximately 15 kgf/mm$^2$. Further, there was no leakage of the coolant water W from the joining interface.

The observation of the semiconductor wafers 5 polished by the apparatuses 1 indicated that the wafers 5 were not damaged, regardless of the dimensions of the wafers 5. Further, there was no significant bending in the wafers 5. In other words, it was apparent that the semiconductor wafers 5 having extremely high accuracy and extremely high quality would be obtained by the table 2 of referential example 1-1.

Referential Example 1-2

In referential example 1-2, a type silicon carbide powder (more specifically, "OY15 (trade name)", product of YAKUSHIMA DENKO KABUSHIKI KAISHA) was employed in lieu of the β type. The density of each resulting base 11A, 11B was 3.1 g/cm$^3$. The heat conductivity of each base 11A, 11B was 125 W/m·K. Each base 11A, 11B contained 0.4 weight percent of boron and 1.8 weight percent of free carbon. The heat conductivity of the bases 11A, 11B in referential example 1-1, in which the β type powder was the starting material, was approximately 20 percent higher than that of referential example 1-2.

After the table 2 was obtained through the same procedure as referential example 1-1, the table 2 was installed in the various types of apparatuses 1 to polish the semiconductor wafers 5 of different dimensions. Accordingly, substantially the same advantageous results as those of referential example 1-1 were obtained.

Conclusion

The first embodiment has the following advantages.

(1) In the table 2 of the wafer polishing apparatus 1, the coolant water W circulates in the passage 12 located in the interface between the bases 11A, 11B. Thus, when the polishing of the semiconductor wafers 5 generates heat, the heat is released efficiently and directly from the table 2. This ensures the diffusion of the heat. Accordingly, compared to the prior art in which the table 2 is mounted on the cooling jacket and indirectly cooled, the temperature difference of the table 2 is further decreased. As a result, the apparatus 1 prevents the wafers 5 from being adversely affected by the heat and enables the diameter of the wafers 5 to be increased. Further, the wafers 5 are polished with high accuracy. This improves the quality of the wafers 5.

(2) The table 2 forms a superimposed structure that includes the two bases 11A, 11B. Thus, after forming the structure that functions as the passage 12 (that is, the groove 13) in one surface of one of the bases 11, the bases 11A, 11B are joined together. This makes it relatively easy to form the passage 12 in the interface between the bases 11A, 11B. Thus, the table 2 is advantageous in that the table 2 is formed relatively easily. Further, this structure does not need to locate a pipe in the joining interface between the bases 11A, 11B. This prevents the structure of the table 2 from becoming complicated and increases in cost.

(3) The two bases 11A, 11B of the table 2 are both dense, sintered silicon carbide bodies, the starring material of which is silicon carbide powder. The dense bodies are preferred in that crystal particles are strongly bonded together and the number of the pores is extremely small. Further, the sintered silicon carbide body, the starting material of which is silicon carbide powder, includes superior heat conductivity, heat-resistant, anti-thermal-shock, and anti-abrasion characteristics compared to other sintered ceramic bodies. Thus, the table 2 of the bases 11A, 11B enables the diameter of each semiconductor wafer 5 to be increased and improves the quality of the wafer 5.

(4) The bases 11A, 11B are securely joined together by the brazing filler layer 14, or the joining material layer. Thus, as compared to the case in which the bases 11A, 11B are joined together without the joining material layer, an increased joining strength is ensured in the interface between the bases 11A, 11B. Accordingly, leakage from the joining interface does not occur when the coolant water W circulates in the passage 12.

If the joining material layer is the brazing filler layer 14 that has a relatively high heat conductivity, heat resistance is reduced in the joining material layer, thus making it difficult to hamper heat transfer between the bases 11A, 11B. This increases heat radiation from the table 2 and further minimizes the temperature differences in the table 2. This also contributes to the increasing of the diameter of each semiconductor wafer 5 and the improvement of the quality of the wafer 5.

(5) If the wafer polishing apparatus 1 includes the table 2, the cooling jacket becomes unnecessary, thus simplifying the entire structure of the apparatus 1.

The first embodiment may be modified as follows.

The joining material layer that joins the bases 11A, 11B together do not necessarily have to be formed of a non-organic joining material such as a brazing filler but may be formed of an organic joining material that contains resin (i.e., an adhesive agent).

Figure 3:
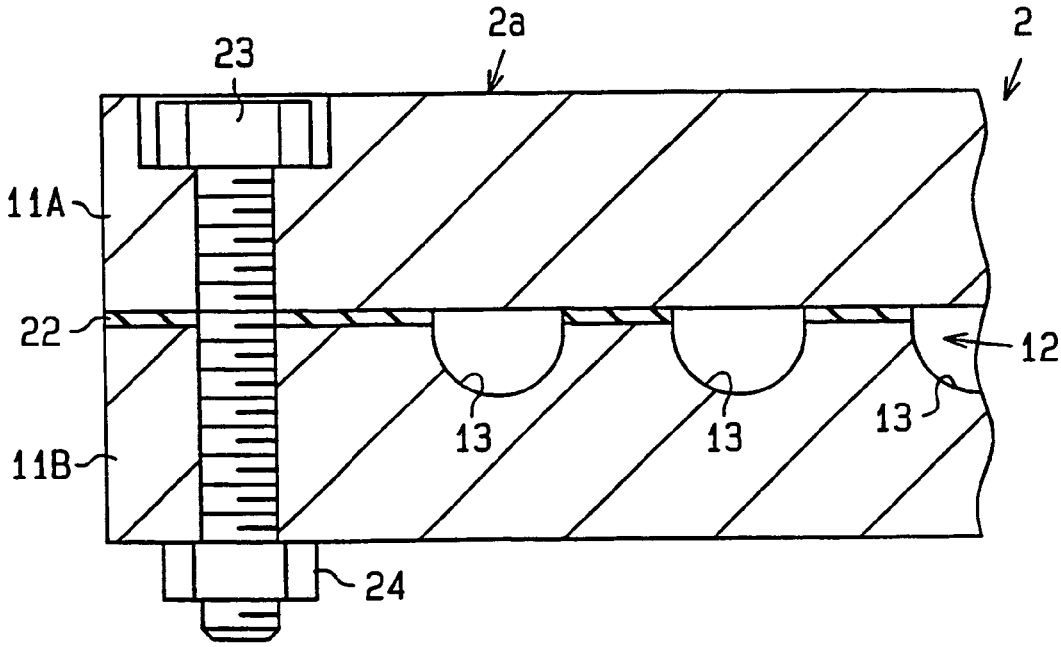
FIG. 3 is an enlarged view schematically showing a main portion of a table according to a first modification of the first embodiment.
Figure 4:
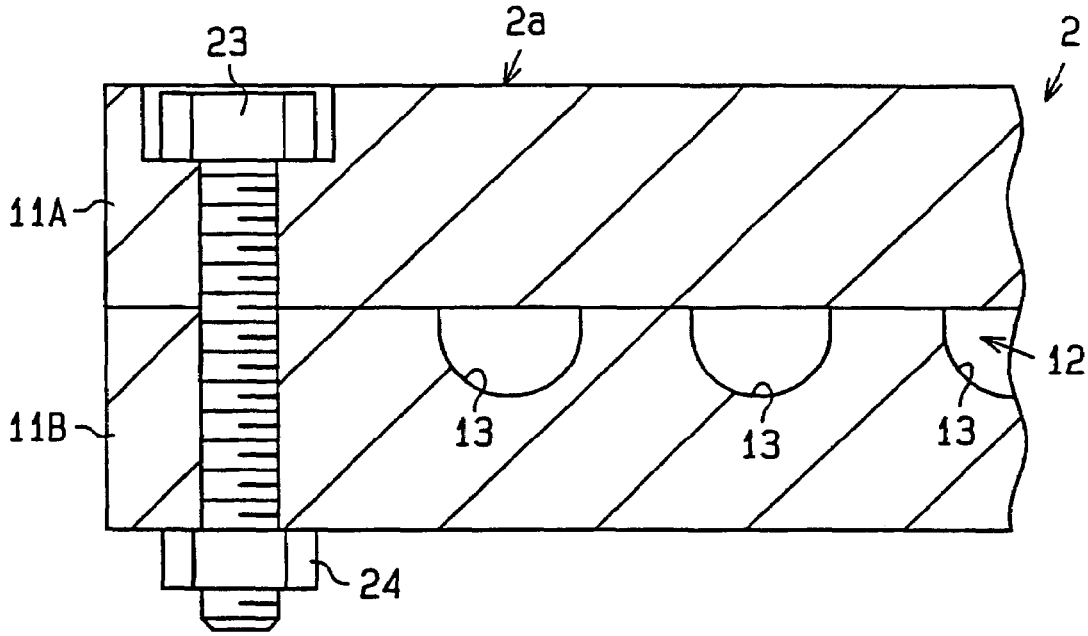
FIG. 4 is an enlarged view schematically showing a main portion of a table according to a second modification of the first embodiment.

The bases 11A, 11B do not necessarily have to be joined together by the joining material layer. For example, in the table 2 of the modification shown in FIG. 3, the joining material layer is eliminated. Instead, the bases 11A, 11B of the table 2 are fastened together by a bolt 23 and a nut 24, thus forming an integral body. Further, a seal member 22, such as a packing, is located in the interface between the bases 11A, 11B to ensure sufficient seal performance. It is especially preferred that the seal member 22 be formed of a material having high heat conductivity. If the fastening force of the bolt 23 and the nut 24 is strong enough, the seal member 22 may be eliminated like the further modification shown in FIG. 4.

Figure 5:
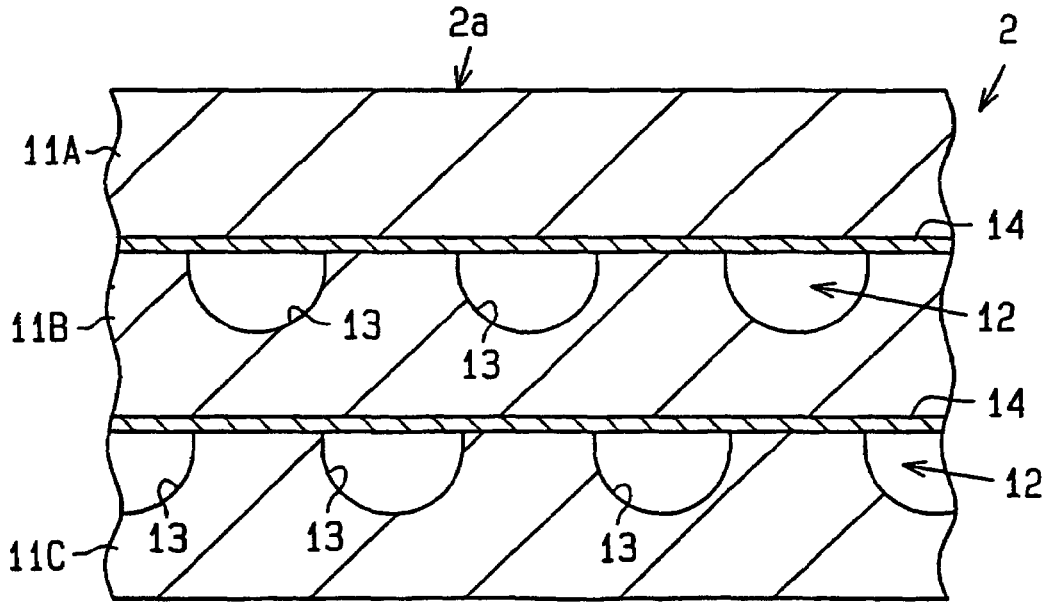
FIG. 5 is an enlarged cross-sectional view showing a main portion of a table according to a third modification of the first embodiment.

Instead of the double layered structure, the table 2 may be a triple layered structure like the modification shown in FIG. 5. Further, the table 3 may include four or more layers.

As silicide ceramic other than silicon carbide, for example, silicon nitride ($Si_3N_4$) or sialon may be selected. It is preferred that the selected silicide ceramic be a dense body with a density of 2.7 g/cm$^3$ or greater.

As carbide ceramic other than silicon carbide, for example, boron carbide ($B_4C$) may be selected. It is preferred that the selected carbide ceramic be a dense body with a density of 2.7 g/cm$^3$ or greater.

In the table 2 of the first embodiment, liquid other than water may circulate through the passage 12. Also, gas may circulate through the passage 12.

Second Embodiment

A wafer polishing apparatus 1 of a second embodiment will now be described in detail with reference to FIGS. 6 and 7.

Figure 6:
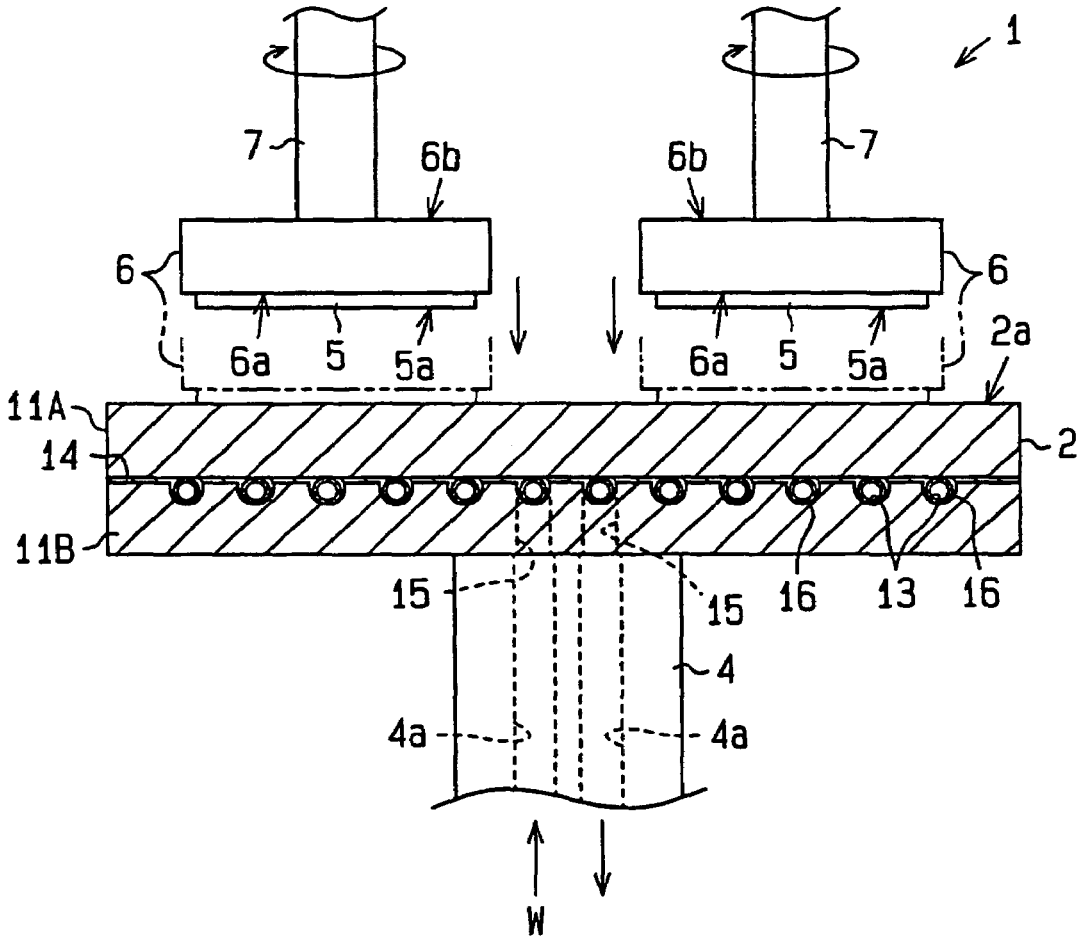
FIG. 6 is a view schematically showing an apparatus of a second embodiment according to the present invention.
Figure 7:
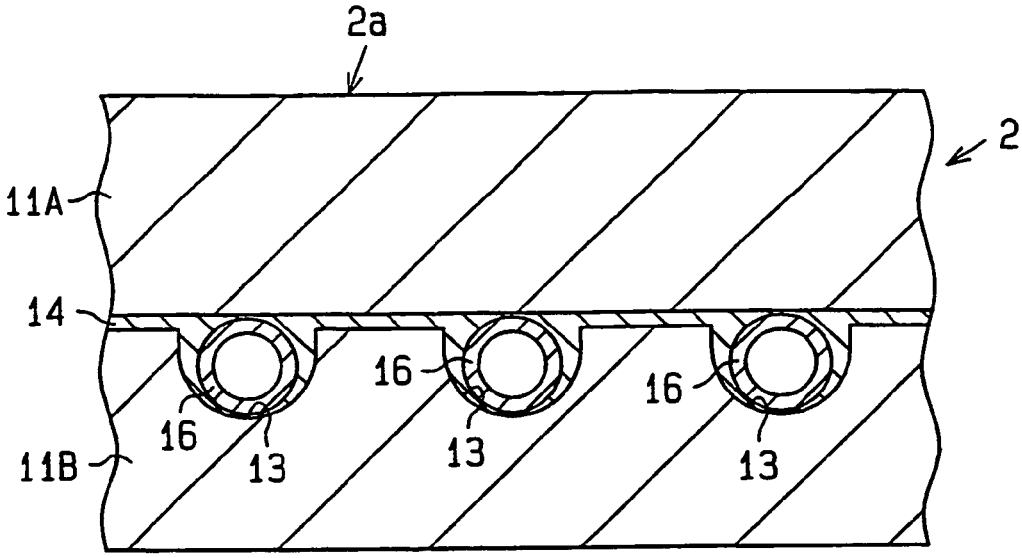
FIG. 7 is an enlarged cross-sectional view showing a main portion of a table used in the apparatus of FIG. 6.

As shown in FIGS. 6 and 7, like the first embodiment, the table 2 of the second embodiment is a layered ceramic structure that includes the two superimposed bases 11A, 11B. The grooves 13, which have a predetermined pattern, are formed in substantially the entire upper side of the lower base 11B. The bases 11A, 11B are integrally joined together by an epoxy resin type adhesive agent layer 14, or an organic joining material layer.

A pipe made from a material having high heat conductivity is formed in the interior of the table 2. The coolant water W, or fluid, circulates in the pipe. More specifically, in the second embodiment, a copper pipe 16 is located in the joining interface between the bases 11A, 11B. Copper is selected as the material of the pipe since it is inexpensive, and easily machined in addition to having a high heat conductivity.

The copper pipe 16 has a circular cross-section. The diameter of the pipe 16 is approximately 5–10 millimeters. The pipe 16 is curved to form a spiral shape as a whole. The adjacent sections of the pipe 16 at its curved portions are spaced from each other at an interval of approximately 5–20 millimeters. The curved pipe 16 is held in the groove 13, which is formed in the upper side of the lower base 11B. In this state, the bases 11A, 11B are joined together. The copper pipe 16 occupies substantially the entire joining interface. Both ends of the pipe 16 are bent downward at a right angle and are received in the corresponding through holes 15. The ends of the pipe 16 are thus connected to the corresponding passages 4*a*, which extend through the rotary shaft 4.

It is preferred that the adhesive agent layer 14 for joining the bases 11A, 11B be formed from an epoxy resin type adhesive agent. This is because this type of adhesive agent resists heat and has superior adhering strength. In this case, it is preferred that the thickness of the adhesive agent layer 14 be approximately 10 to 30 micrometers. Further, it is preferred for the adhesive agent to have a thermosetting property.

A procedure for fabricating the table 2 of the second embodiment will hereafter be described briefly.

First, like the first embodiment, the two bases 11A, 11B, each of which is formed by a silicon carbide sinter, are formed through molding and calcinating, using silicon carbide as a starting material.

Subsequently, one side of the lower base 11B is ground with a grinder to form the grooves 13 with a predetermined width and a predetermined depth in substantially the entire surface. Further, the adhesive agent is applied on one side of the upper base 11A, and the pipe 16 is arranged in the grooves 13. The two bases 11A, 11B are then superimposed. In this state, the bases 11A, 11B are heated to the hardening temperature of the resin, thus joining the bases 11A, 11B together. Finally, the upper side of the upper base 11 is polished to form the polishing surface 2*a* and complete the table 2.

The following are referential examples of the second embodiment.

Referential Example 2-1

In referential example 2-1, like referential example 1-1, the bases 11A, 11B, which were formed of sintered silicon carbide bodies, were molded, using silicon carbide powder that contained β type crystals as a starting material, and calcinated. Further, the copper pipe 16, the diameter of which was 6 millimeters, was prepared and bent into a predetermined shape.

Next, the groove 13, the depth of which was 10 millimeters and the width of which was 10 millimeters, was ground in the upper side of the lower base 11B. The curved portion of the copper pipe 16 was then fitted in the groove 13. In this state, the bases 11A, 11B were integrally adhered together with an epoxy resin type adhesive agent. The thickness of the adhesive agent layer 14 was approximately 20 micrometers. Further, the upper side of the upper base 11A was polished to complete the table 2.

The resulting table 2 of referential example 2-1 was installed in the aforementioned various types of apparatuses 1. The semiconductor wafers 5 of different dimensions were then polished with the apparatuses 1 with the coolant water W constantly circulating through the copper pipe 16. Thermal deformations were not found in the table 2. Further, the adhesive agent layer 14 did not crack, and the joining strength of the joining interface between the bases 11A, 11B was high. Also, a breakage test was conducted on the table 2 using a conventional method complying with JIS R 1624 to measure the flexural strength of the interface. The value was approximately 4 kgf/mm$^2$. Further, no leaks of coolant water W from the joining interface were noted.

Observation of the semiconductor wafers 5 polished by the apparatuses 1 indicated that the wafers 5 were not damaged regardless of the dimensions of the wafers 5. Further, no significant bending was found in the wafers 5. In other words, it was apparent that the table 51 of referential example 2-1 manufactured the semiconductor wafers 5 with extremely high accuracy and extremely high quality.

Referential Example 2-2

In referential example 2-2, like referential example 1-2, the bases 11A, 11B, which were formed of sintered silicon carbide bodies, were molded, using silicon carbide powder that contained α type crystals as a starting material, and calcinated. Afterwards, the table 2 was completed by the same procedure as that of referential example 2-1. The table 2 was then installed in the aforementioned various types of apparatuses 1 to polish the semiconductor wafers 5 that had different dimensions. Accordingly, substantially the same superior results as those of referential example 2-1 were obtained.

Conclusion

The second embodiment has the following advantages.

(1) In the table 2 of the second embodiment, the coolant water W circulates through the copper pipe 16, which is formed from a material having highly heat conductivity and which is located in the joining interface between the ceramic bases 11A, 11B. Thus, when the polishing of semiconductor wafers 5 generates heat, the heat is released efficiently and directly from the table 2. This radiates the heat. Accordingly, compared to the prior art in which the table 2 is mounted on the cooling jacket to indirectly cool the table 2, the temperature differences in the table 2 is further decreased. As a result, the apparatus 1 prevents the wafers 5 from being adversely affected by the heat and enables the diameter of the wafers 5 to be increased. Further, the wafers 5 can be polished with high accuracy, thus improving the quality of the wafers 5.

(2) In the table 2 of the second embodiment, the coolant water W circulates in the pipe 16. Thus, the table 2 is advantageous in that the bases 11 are not exposed directly to the coolant water W. Further, this structure prevents the coolant water W from leaking from the joining interface.

(3) The table 2 employs a layered structure that includes the two bases 11A, 11B. Thus, after forming the grooves 13 in the upper surface of the lower base 11B and arranging the pipe 16 in the grooves 13, the bases 11A, 11B are joined together with the adhesive agent. This makes it relatively easy to form the coolant water passage 12 in the interface between the bases 11A, 11B. As a result, the table 51 is advantageous in that the table is easily fabricated.

(4) The two bases 11A, 11B of the table 2 are both dense bodies formed from silicon carbide sinters, the starting materials of which are silicon carbide powder. The dense bodies are preferred in that crystal particles are strongly bonded together and the number of the pores is extremely small. Further, the sintered silicon carbide body, the starting material of which is silicon carbide powder, includes superior heat conductivity, heat-resistant, anti-thermal-shock, and anti-abrasion characteristics compared to other sintered ceramic bodies. Thus, by using the table 2 formed by the bases 11A, 11B to perform polishing, the diameter of each semiconductor wafer 5 may be increased while improving the quality of the wafer 5.

(5) In the table 2, the copper pipe 16 is held in the groove 13. Thus, as shown in FIG. 7, the bases 11A, 11B are adhered together located close to each other. This reduces the thickness of the adhesive agent layer 14, thus preventing the adhesive agent layer 14 from cracking. The joining strength of the adhesive agent layer 14 thus increases. Accordingly, the table 2 is not easily damaged by heat.

(6) In the table 2, the grooves 13 have a round cross-section, and grooves 13 accommodate the pipe 16, the cross-section of which is round. This reduces the space formed between the inner wall of the groove 13 and the outer side of the pipe 16 when the pipe 16 is accommodated in the groove 13. Thus, the amount of the adhesive agent layer 14 filling the space between the inner wall of the groove 13 and the outer side of the pipe 16 is small. This reduces heat resistance of the adhesive agent layer 14 accordingly. As a result, the heat releasing effect is improved, and the temperature differences in the table 2 are further decreased.

(7) In the second embodiment, the pipe material is copper, which is inexpensive and easy to machine. This decreases the cost of the table 2. Further, copper has high heat conductivity. Thus, the copper pipe 16 improves the heat radiating effect and suppresses the temperature differences in the table 2.

(8) If the table 2 of the second embodiment is installed in the wafer polishing apparatus 1, the cooling jacket is not required. This simplifies the apparatus structure as a whole.

The second embodiment may be modified as follows.

Figure 8:
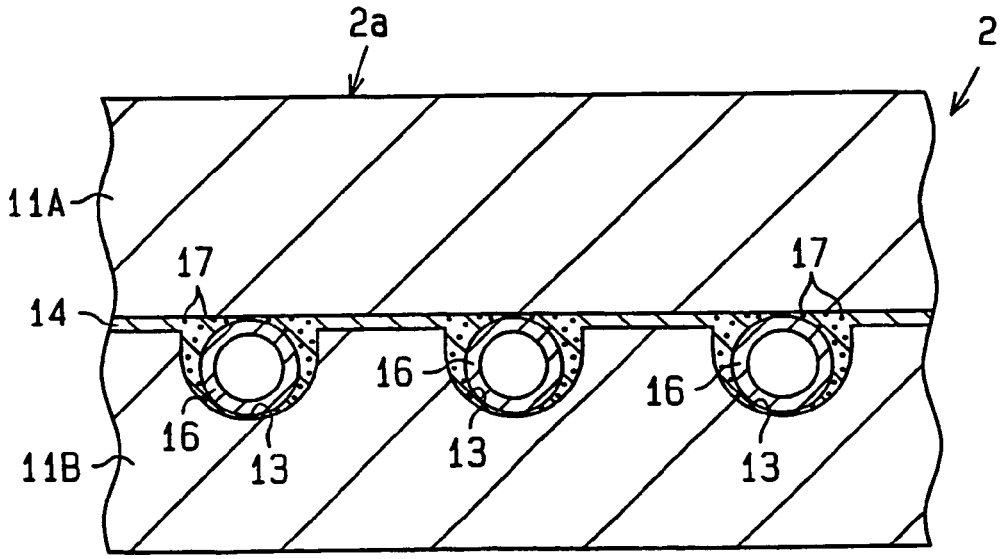
FIG. 8 is an enlarged cross-sectional view showing a main portion of a table according to a first modification of the second embodiment.

In a modification of the table 2, as shown in FIG. 8, powder formed from a substance having a high heat conductivity is mixed in the adhesive agent layer 14 at least in the space around the pipe 16 as a filler. It is preferred that a copper powder 17 that has an average particle diameter of approximately 50 to 200 micrometers is selected as the powder. It is also preferred that the copper powder 17 be concentrated only around the pipe 16 in the adhesive agent layer 14, or that the amount of the copper powder 17 in the joining interface between the bases 11A, 11B be minimal. This increase heat conductivity of the joining interface between the bases 11A, 11B and increases the joining strength of the interface.

Other than the copper powder 17, the powder may be at least one type of metal powder selected from, for example, gold, silver, and aluminum. Further, the powder may be a ceramic powder such as alumina, aluminum nitride, and silicon carbide.

The table 2, modified as described above, is fabricated by a procedure in which the grooves are first formed in the upper side of the lower base 11B, the copper powder 17 is then filled in the groove 13, and, in this state, adhesive agent is applied to join the base 11A, 11B together.

Figure 9:
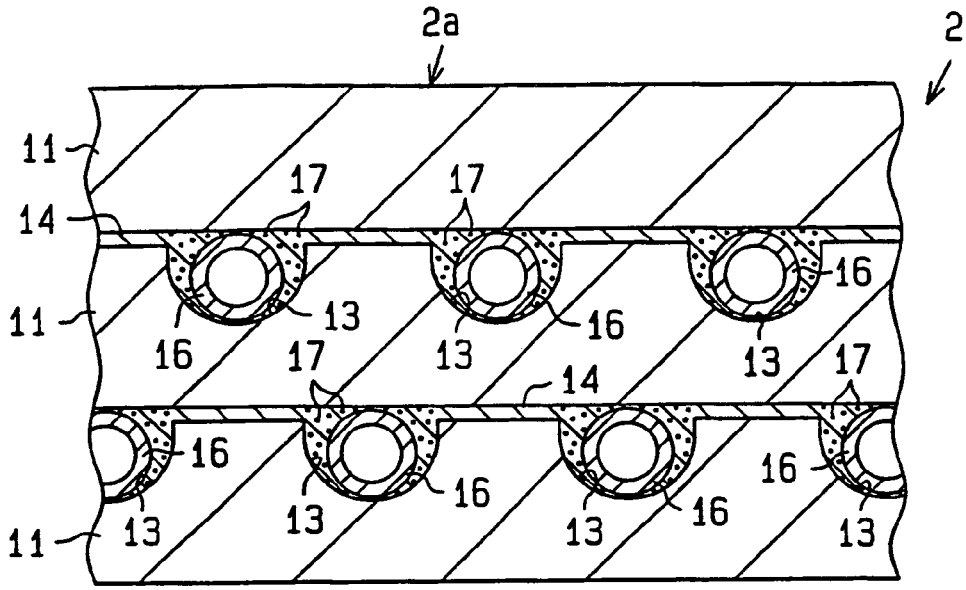
FIG. 9 is an enlarged cross-sectional view showing a main portion of a table according to a second modification of the second embodiment.

Instead of the table 2 that has the double layered structure, the table 2 may be formed as a triple layered structure, as shown in a modification of FIG. 9. Further, the table 2 may be a structure that has four or more layers.

Figure 10:
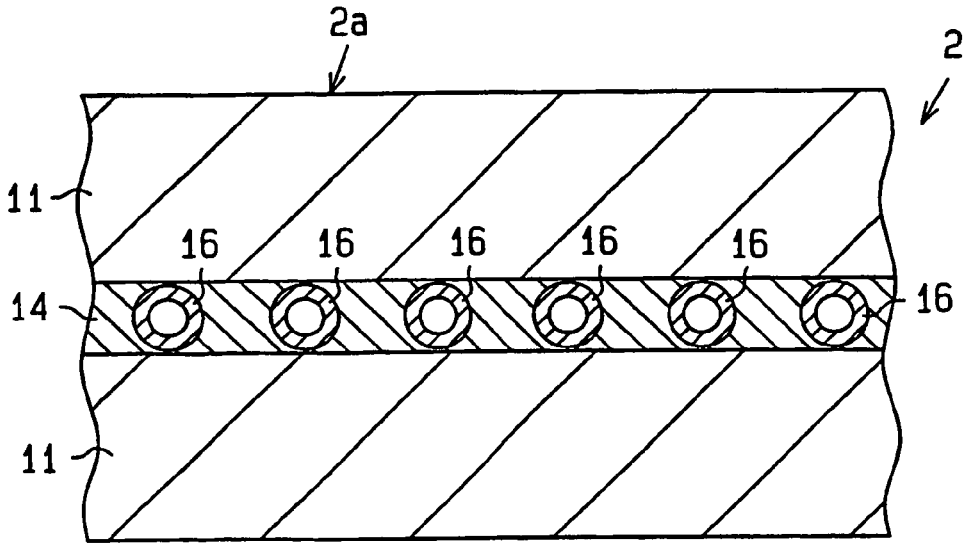
FIG. 10 is an enlarged cross-sectional view showing a main portion of a table according to a third modification of the second embodiment.

In a modification of the table 2, as shown in FIG. 10, the bases 11A, 11B may be joined together with the copper pipe 16 placed along a flat surface, without forming the groove 13 for receiving the pipe in the upper side of the lower base 11B.

The material of the pipe 16 is not restricted to copper, as indicated in the second embodiment. The pipe material may be made of other metals that have high heat conductivity, for example, copper alloy or aluminum.

A silicide ceramic other than silicon carbide such as silicon nitride ($Si_3N_4$) or sialon may be selected. In this case, it is preferred that the selected silicide ceramic be a dense body having a density of 2.7 g/cm$^3$ or greater.

The carbide ceramic may be, for example, boron carbide ($B_4C$), other than silicon carbide. In this case, it is preferred that the selected carbide ceramic is a dense body with a density of 2.7 g/cm$^3$ or greater.

In the table 2 of the second embodiment, liquid other than water may circulate in the pipe 16. Further, gas may circulate through the pipe 16.

Third Embodiment

In a third embodiment, an improvement is made to further improve heat uniformity in the tables 2 of the first embodiment and its modifications (for the sake of brevity, these tables 2 are hereafter referred to as type A table 2). In the type A table 2, the grooves 13, which form part of the water passage 12, are formed in the upper side of the lower base 11B. Thus, the lower side of the upper base 11A (the heat transmitting surface with respect to the coolant water W that flows in the water passage 12) is flat.

Figure 11:
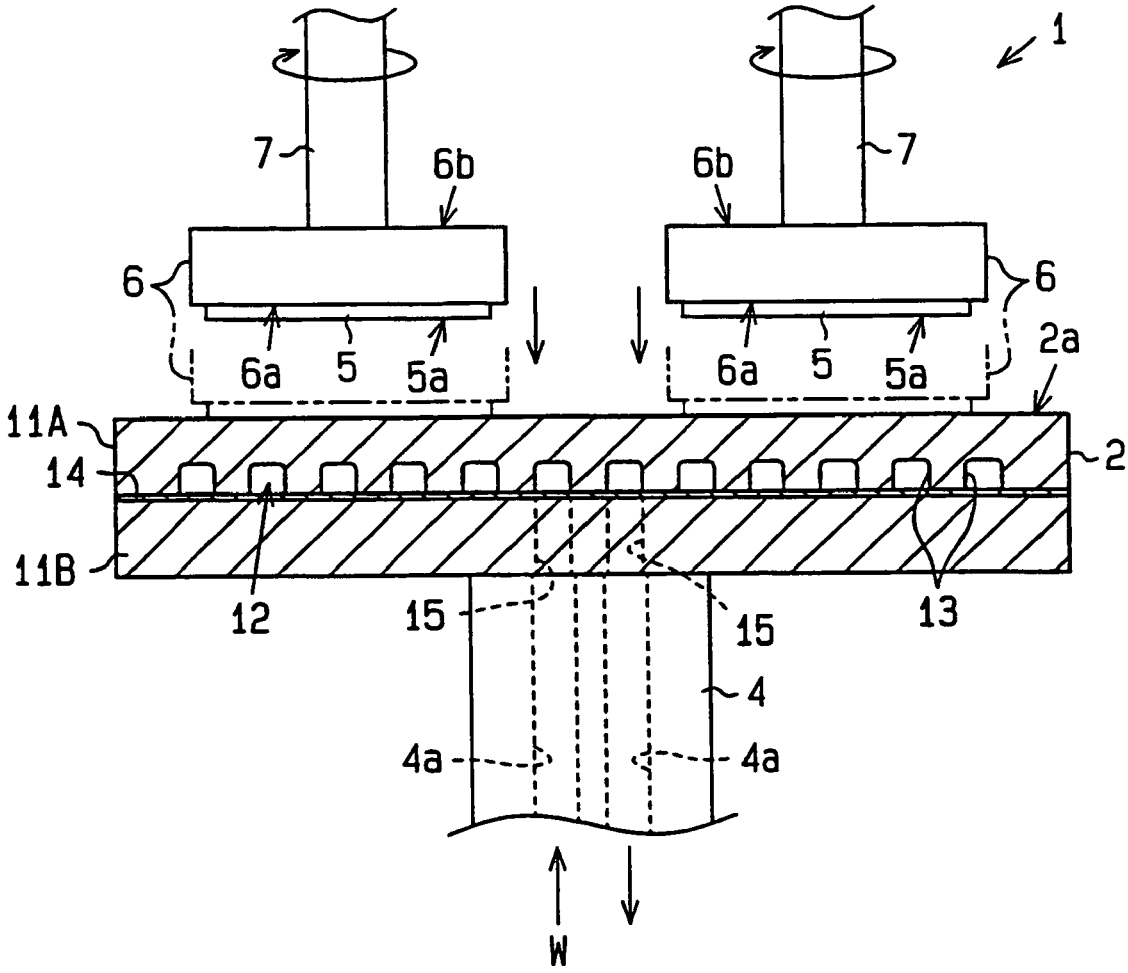
FIG. 11 is a view schematically showing an apparatus of a third embodiment according to the present invention.
Figure 12:
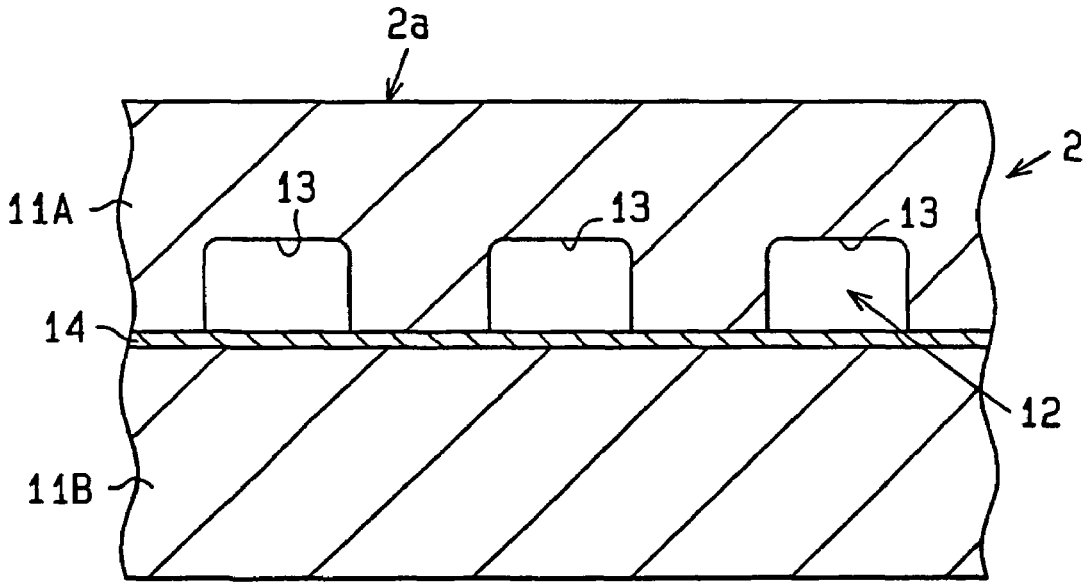
FIG. 12 is an enlarged cross-sectional view showing a main portion of a table used in the apparatus of FIG. 11.

In contrast, in the table 2 of the third embodiment, the groove 13 is formed in the lower side of the upper base 11A, as shown in FIGS. 11 and 12. The grooves 13 are not formed in the upper side of the lower base 11B.

It is preferred that the depth of the groove 13 is ⅓ to ½ of the thickness of the upper base 11A (in the third embodiment, 3 to 20 millimeters).

When the groove 13 is not deep enough, the recesses formed in the lower side of the upper base 11A are small and the heat transmitting area is insufficient. Further, the flow passage cross-sectional area is insufficient. This restricts the amount of the water coolant W that flows in the water passage 12. Accordingly, the heat uniformity of the table 2 is not sufficiently improved. In contrast, if the grooves 13 are too deep, the upper base 11A is partially thin. This would decrease the rigidity of the upper base 11A. Accordingly, if the material of the upper base 11A is not optimally selected, the pressing force applied by the plate 6 may damage the upper base 11A.

As schematically shown in FIG. 12, it is preferred that the grooves 13 have a rectangular cross-section. More specifically, it is preferred that the cross-section of each corner of the grooves 13 has an R of 0.3 to 5. If the R is less than 0.3, stress concentration and machining may form cracks and cause the table 2 to easily break. In contrast, if the R is greater than 5, the flow passage cross-sectional area would be insufficient, and the heat uniformity of the table 2 would not be improved.

Further, it is preferred that the groove 13 be a ground groove or be formed by grinding the lower side of the upper base 11A with a grinder. If the grooves 13 are formed through grinding, the grooves 13 would have corners having an R that is included in the optimal range and would have the preferred cross-sectional form. In addition, grinding easily forms the deep grooves 13 in a hard ceramic material such as a silicon carbide sinter.

The following is a referential example of the third embodiment.

Referential Example 3-1

In referential example 3-1, like referential example 1-1, the bases 11A, 11B, which were formed of silicon carbide sinters, were molded, using silicon carbide powder as starting material, and calcinated.

Next, the groove 13 was formed in the lower side of the upper base 11A with a grinder such that the groove 13 had a depth of 5 millimeters and a width of 10 millimeters and each corner of the groove 13 had an R of one millimeter. The depth of the groove 13 was half of the thickness of the upper base 11A. The upper and lower bases 11A, 11B were then integrally brazed. After the brazing, the upper side of the upper base 11A was polished to produce the table 2 having the polishing surface 2*a*.

The resulting table 2 of referential example 3-1 was installed in the aforementioned various types of apparatuses 1. The semiconductor wafers (silicon wafers) 5 of different dimensions were then polished with the apparatuses 1 while constantly circulating the coolant water W. During the polishing, the temperature was measured at a number of points on the polishing surface 2*a*. The measurement indicated that the temperature differences in the table 2 were extremely small (more specifically, within ±2 degrees Celsius from 40 degrees Celsius). In other words, the effect of suppressing the heat variation was improved. Further, the observation of the wafers 5 polished by the apparatuses 1 indicated that the wafers 5 were preferably formed, or were not damaged or bent at all, regardless of the dimensions of the wafers 5. In other words, it was apparent that the semiconductor wafers 5 had an extremely high accuracy and high quality when using the table 2 of referential example 3-1.

Conclusion

Accordingly, the third embodiment has the following effects.

(1) The grooves 13, which form part of the water passage 12 in the table 2, is formed in the lower side of the upper base 11A of the layered ceramic structure. That is, the lower side of the upper base 11A includes recesses to ensure sufficient heat transmitting area. Thus, compared to the first embodiment and its modifications, heat is transmitted to the water W more efficiently. This improves the heat uniformity of the table 2, thus making it relatively easy to control the temperature by supplying fluid. Accordingly, the wafer 5 is machined with high accuracy such that the diameter of the wafer 5 is increased and the quality of the wafer 5 is improved.

(2) In the table 2, the depth of the groove 13 is included in the aforementioned preferred range. This maintains the strength of the table 2 and ensures sufficient heat transmitting area and sufficient flow passage cross-sectional area. Thus, the durability of the table 2 and the heat uniformity of the table 2 are improved.

(3) In the table 2, each corner of the rectangular cross section of the groove 13 has an R included in the aforementioned preferred range. Thus, compared to a groove with a round cross-sectional shape of the same depth as that of the groove 13, the groove 13 has a relatively large flow passage cross-sectional area. This further improves the heat uniformity of the table 2.

The third embodiment may be modified as follows.

The bases 11A, 11B do not necessarily have to be joined together by the brazing filler layer 14. For example, a bolt and a nut that fasten the bases 11A, 11B together, may replace the brazing filler layer 14. That is, the aforementioned structures of FIGS. 3 and 4 may be employed.

The grooves 13 do not necessarily have to be formed through grinding but may be formed through blasting such as sand blasting. Further, the cross-section form of the groove 13 does not have to be generally rectangular or cornered like in the third embodiment and may be substantially V-shaped or semicircular.

Fourth Embodiment

The fourth embodiment employs the following structure to prevent the type A table 2 from being flexed.

More specifically, the Young's modulus of the two bases 11A, 11B, which are formed of ceramic, is 1.0 kg/cm$^2$($\times 10^6$) or greater. It is preferred that the Young's modulus be 1.0–10.0 kg/cm$^2$($\times 10^6$) and is particularly preferred that the Young's modulus be 1.0–5.0 kg/cm$^2$($\times 10^6$). This is because when the Young's modulus is less than 1.0 kg/cm$^2$($\times 10^6$), the rigidity of the table 2 would be insufficient. Although a higher Young's modulus is preferred, it would be difficult to procure material having a Young's modulus that is greater than 10.0 kg/cm$^2$($\times 10^6$) in an inexpensive and stable manner.

The following is a referential example of the fourth embodiment.

Referential Example 4-1

In referential example 4-1, like referential example 3-1, the bases 11A, 11B, which were formed from a silicon carbide sinter, were molded, using silicon carbide powder as a starting material, and calcinated. The Young's modulus of each base 11A, 11B was 3.5 kg/cm$^2$($\times 10^6$). The upper base 11A was then ground with a grinder, and the bases 11A, 11B were brazed to each other. After the brazing, the upper side of the upper base 11A was polished to complete the table 2 provided with the polishing surface 2*a*.

The resulting table 2 of referential example 4-1 was installed in the aforementioned various types of apparatuses 1. The semiconductor wafers (silicon wafers) 5 of different dimensions were then polished with the apparatuses 1 while constantly circulating the coolant water W. As a result, flexing of the table 2 was not found, and the flatness of the polishing surface 2*a* was maintained.

The flatness of each wafer 5 polished by the apparatus 1 was also measured. The measurement indicated that the flatness of each wafer 5 was 2 micrometers or less in 600 millimeters Φ. Further, the flatness of the table 2 at 40 degrees Celsius was 5 micrometers or less. The wafers 5 were not damaged. In other words, it was apparent that the semiconductor wafers 5 had an extremely high accuracy, high quality, and large diameter when using the table 2 of referential example 4-1.

Conclusion

In the fourth embodiment, the bases 11A, 11B, or the components of the table 2, are formed from a dense silicon carbide sinter that has a high Young's modulus. The table 2 thus has the preferred rigidity. Thus, during usage, the table 2 is not flexed or deformed as a whole even if a pressing force is applied to the polishing surface 2*a*. This maintains the flatness of the polishing surface 2*a*. Thus, the wafers 5 are polished with high accuracy, and the flatness of the resulting wafers 5 is increased. Accordingly, the table 2 enables the diameter of each semiconductor wafer 5 to be increased and improves the quality of the wafer 5.

The fourth embodiment may be modified as follows.

In the fourth embodiment, the table 2 has a double layered structure. However, the table 2 may have a triple layered structure. Alternatively, the table 2 may be a multiple layered structure that includes four or more layers. Further, the water passage 12 may be eliminated such that the table 2 has a single layered structure (or a non-layered structure).

In the fourth embodiment, the groove 13 is formed in only the upper base 11A. Alternatively, the groove 13 may be formed in only the lower base 11B or both the upper and lower bases 11A, 11B.

In the fourth embodiment, the upper base 11A is formed of a dense silicon carbide sinter, and the lower base 11B is formed of a porous silicon carbide sinter. However, the bases 11A, 11B are not restricted to this combination. For example, both the upper and lower bases 11A, 11B may be formed of dense or porous silicon carbide sinters.

A silicide ceramic other than silicon carbide, for example, silicon nitride or sialon may be selected. A carbide ceramic other than silicon carbide, for example, boron carbide may be selected. Further, other than these types, oxide ceramic such as alumina or metal may be used. In either case, it is preferred Young's modulus be equal to or greater than 1.0 $kg/cm^2(\times 10^6)$

Fifth Embodiment

The fifth embodiment includes the following structure to improve the heat uniformity and breakage strength of the A type table 2.

In the fifth embodiment, the brazing filler layer 14 arranged between the bases 11A, 11B is formed by performing brazing with a brazing filler that contains silver as a main component (i.e., a brazing filler which largest component is silver). In this case, in addition to silver, it is preferred that the brazing filler contain copper as another main component (i.e., silver being the largest component and copper being the second largest component). Representative examples of the brazing filler include silver brazing fillers such as BAg-1, BAg-1a, and BAg-2 (brazing fillers that contain silver and copper as main components and zinc and cadmium in small quantities), which are defined by JIS. Further, the brazing filler may be BAg-3 (a brazing filler that contains silver and copper as main components and zinc, cadmium, and nickel in small quantities), BAg-4 (a brazing filler that contains silver and copper as main components and zinc and nickel in small quantities), BAg-5 or BAg-6 (a brazing filler that contains silver and copper as main components and zinc in a small quantity), or BAg-7 (a brazing filler that contains silver and copper as main components and zinc and tin in small quantities). Further, it is preferred that a brazing filler with a relatively high melting temperature (for example, BAg-2, BAg-3, BAg-4, BAg-5, or BAg-6) be selected to enhance the heat resistance of the brazing portion. In addition, a brazing filler that contains silver and copper as main components but does not contain zinc or nickel or tin or cadmium, which are small quantity components in the aforementioned brazing fillers, may be selected.

It is further preferred that each of the aforementioned brazing fillers contains a small quantity of titanium (Ti) in addition to silver (Ag) and copper (Cu), which are the main components. Titanium has a large diffusion coefficient with respect to a sintered silicon carbide body and easily diffuses in the pores of the sintered body during the brazing. The content of titanium in the brazing filler is preferably 0.1–10 weight percent, and, more preferably, 1–5 weight percent.

It is preferred that the thickness of the brazing filler layer 14 formed from the aforementioned brazing fillers be approximately 10–50 micrometers, and, more preferably, 20–40 micrometers, from the viewpoint of joining strength and cost.

The fifth embodiment also has the following improvement to prevent the table 2 from being flexed by thermal stress and to improve the flatness of the wafers 5.

More specifically, the bases 11A, 11B of the fifth embodiment have substantially equal thermal expansion coefficients. That is, the difference of the thermal expansion coefficient between the bases 11A, 11B is preferably $1.0\times 10^{-6}$/degree Celsius or smaller, more preferably $0.5\times 10^{-6}$/degree Celsius or smaller, and, further preferably, $0.2\times 10^{-6}$/degree Celsius or smaller. As the difference becomes smaller, the thermal stress that would otherwise cause flexing or cracking is further prevented from being generated.

The thermal expansion coefficient of each base 11A, 11B at 0–400 degrees Celsius is preferably $8.0\times 10^{-6}$/degree Celsius or smaller, more preferably $6.5\times 10^{-6}$/degree Celsius or smaller, and, most preferably, $5.0\times 10^{-6}$/degree Celsius or smaller. This maximally suppresses the difference between the thermal expansion coefficient of silicon, or $3.5\times 10^{-6}$/degree Celsius, and the thermal expansion coefficient of the table 2. Further, it is preferred that the thermal expansion coefficient of each base 11A, 11B at 0–400 degrees Celsius be equal to or larger than $2.0\times 10^{-6}$/degree Celsius.

The fifth embodiment further has the following improvement to improve the heat uniformity of the table 2.

More specifically, it is preferred that the heat conductivity TC1 of the upper base 11A, which is formed from ceramic, be equal to or larger than the heat conductivity TC2 of the lower base 11B, which is also formed from ceramic, thus satisfying the following condition of TC1≧TC2. In the fifth embodiment, a dense body with strongly bonded crystal particles and an extremely small number of pores is selected as the material of the upper base 11A. In contrast, a porous body with a large number of pores is selected as the material of the lower base 11B. Further, the upper base 11A is thinner than the lower base 11B. The anti-heat resistance of the upper base 11A is thus lower than that of the lower base 11B. More specifically, it is preferred that the thickness of the upper base 11A be 3–20 millimeters and the thickness of the lower base 11B be 10–50 millimeters.

If the upper base 11A is formed from a silicon carbide sinter, it is preferred that the heat conductivity of the upper base 11A be 40 W/m·K or higher, and, more preferred that the heat conductivity be 80–200 W/m·K. If the heat conductivity is too low, temperature differences tend to be produced. This interferes with increasing the diameter and improving the quality of the semiconductor wafer 5. In contrast, although it is preferred that the heat conductivity be greater, material having heat conductivity that is greater than 200 W/m·K is difficult to procure inexpensively and stably. If the lower base 11B is formed from a sintered silicon carbide body, the heat conductivity of the sintered body is preferably 5 W/m·K or higher, and, more preferably, 10–40 W/m·K. This prevents heat from being released from an area lower than the water passage 12, or a cooling portion, thus making it easy to control the temperature of the polishing surface 2*a*.

The following are referential examples of the fifth embodiment.

Referential Example 5-1

To form the upper base 11A, "beta random (trade name)", product of IBIDEN KABUSHIKI KAISHA, was used as silicon carbide powder that contained 94.6 weight percent of β type crystals. The average crystal particle diameter of the powder was 1.3 micrometers. The powder contained 1.5 weight percent of boron and 3.6 weight percent of free carbon.

First, 5 weight parts of polyvinyl alcohol and 300 weight parts of water were added to 100 weight parts of the silicon carbide powder. The mixture was then stirred in a ball mill for five hours to obtain a uniform mixture. The mixture was dried for a predetermined time to remove a certain amount of moisture from the mixture. The dry mixture was then sampled in an appropriate amount. The sample was granulated. Next, the granules of the dry mixture were molding with metal press dies at a pressure of 50 kg/cm$^2$. The density of the resulting molded body was 1.2 g/cm$^3$.

Subsequently, the lower side of the body that forms the upper base 11A was ground to form the groove 13 having a depth of 5 millimeters and a width of 10 millimeters.

Next, the molded product was placed in a graphite crucible sealed from ambient air. The body was then calcinated using a Tammann type calcinating furnace. The calcination was performed in an argon gas atmosphere of one atmospheric pressure. During the calcination, the temperature was increased at a rate of 10 degrees Celsius per minute to a maximum temperature of 2300 degrees Celsius. The maximum temperature was maintained for two hours. The observation of the resulting upper base 11A revealed an extremely dense, three-dimensional network structure in which plate crystals were entangled in multiple directions. Further, the density of the upper base 11A was 3.1 g/cm$^3$. The heat conductivity (TC1) of the upper base 11A was 150 W/m·K. The upper base 11A contained 0.4 weight percent of boron and 1.8 weight percent of free carbon. The diameter of the upper base 11A was 600 millimeters, and the thickness of the upper base 11A was 5 millimeters.

As for the lower base 11B, a commercially available porous silicon carbide sinter (more specifically, "SCP-5 (trade name)", product of IBIDEN KABUSHIKI KAISHA) was used. The density of the sintered body was approximately 1.9 g/cm$^3$, and the heat conductivity (TC2) of the sintered body was 30 W/m·K. Further, the porosity of the sintered body was 40–45%. The diameter of the resulting lower base 11B was 600 millimeters, and the thickness of the base 11B was 25 millimeters. The thermal expansion coefficient of the upper base 11A at 0–400 degrees Celsius was $4.5\times10^{-6}$/degrees Celsius, and the thermal expansion coefficient of the lower base 11B at 0–400 degrees Celsius was $4.4\times10^{-6}$/degrees Celsius. The difference of the thermal coefficient between the upper and lower bases 11A, 11B was $0.1\times10^{-6}$/degrees Celsius.

The two bases 11A, 11B were then integrally brazed to each other. A foil-like brazing filler having a thickness of 50 micrometers was used. The brazing filler contained 63 weight percent of silver, 35 weight percent of copper, and 2 weight percent of titanium. In other words, the brazing filler contained silver and copper as main components and titanium in a small quantity. The heating temperature for brazing was 850 degrees Celsius, which was the melting temperature of the brazing filler. The thickness of the brazing filler layer was 20 micrometers.

After the brazing, the upper side of the upper base 11A was polished to form the table 2 provided with the polishing surface 2*a*.

The resulting table 2 of referential example 5-1 was installed in the aforementioned various types of apparatuses 1. The semiconductor wafers (silicon wafers) 5 having different dimensions were then polished by the apparatuses 1 at a high temperature of several hundreds of degrees Celsius, while constantly circulating the coolant water W. As a result, no flexing of the table 2 was found. Further, no cracks were found in the brazing filler layer 14, and the bonding strength was maintained in the joining interface between the bases 11A, 11B. Also, a breakage test was conducted on the table 2 using a conventional method complying with JIS R 1624 to measure the flexural strength of the interface. The value was approximately 30 kgf/mm$^2$. Further, no leaks of coolant water W from the joining interface were noted.

The observation of the wafers 5 polished by the apparatuses 1 indicated that the wafers 5 were not damaged, regardless of the dimensions of the wafers 5. Further, no significant bending was noted in the wafers 5. More specifically, the flatness of each wafer 5 was 2 micrometers or less in 600 millimeters Φ. Further, the flatness of the table 2 at 40 degrees Celsius was 5 micrometers or less.

In other words, it was apparent that the semiconductor wafers 5 produced using the table 2 of referential example 5-1 had an extremely high accuracy and high quality.

Referential Example 5-2

Subsequently, the table 2 like that of referential example 5-1 was fabricated using a general silver brazing filler that contained no titanium (BAg-6; containing 50 weight percent of silver, 34 weight percent of copper, and 16 weight percent of zinc). A breakage test was conducted with the resulting table 2 of referential example 5-2, and the bending strength of the joining interface was measured through the method complying with JIS R 1624. The measured value was 10 kgf/mm$^2$, which is lower that that of referential example 4-1. In other words, compared to referential example 5-1, the bonding strength of the joining interface of the table 2 of referential example 5-2 was lower. Further, although no cracks were currently found, it was assumed that the table 2 would be damaged due to cracking if the table 2 was continuously used for a long time.

Conclusion

Accordingly, the fifth embodiment has the following effects.

(1) The brazing filler layer 14 arranged between the bases 11A, 11B contains a predetermined amount of titanium that has an increased diffusion coefficient with respect to the sintered silicon carbide body. Thus, during the brazing, titanium diffuses in the pores of the sintered body, thus ensuring a sufficient bonding strength in the joining interface between the bases 11A, 11B. Accordingly, regardless of long-term use, damages of the joining interface caused by cracking are prevented. The strength of the table 2 is thus improved.

Further, the brazing filler is a non-organic joining material. The brazing filler does not deteriorate or change quality even when exposed to a high temperature of several hundreds of degrees Celsius. This maintains the bonding strength of the joining interface. Accordingly, the table 2, formed by such brazing filler, has improved anti-heat resistance compared to when using an organic joining material.

(2) The brazing filler of the table 2 of the fifth embodiment has a high heat conductivity compared to an organic joining material such as an adhesive agent. This reduces the anti-heat resistance in the joining surface. The temperature differences in the table 2 are thus decreased. Accordingly, compared to when the table 2 is mounted on a cooling jacket to indirectly cool the table 2, heat is efficiently released from the table 2. This further decreases the temperature differences in the table 2. As a result, the heat uniformity of the table 2 is improved. Further, this enables the diameter of each semiconductor wafer 5 to be increased and improves the quality of the wafer 5.

(3) In the table 2 of the fifth embodiment, the bases 11A, 11B are brazed together by the brazing filler layer 14 that contains silver and copper as main components. The brazing filler layer 14 is formed with a relatively inexpensive brazing filler. This reduces the cost of the table 2. Further, the titanium content of the brazing filler layer 14 is selected to be in a preferred range of 0.1–10 weight percent. This further improves the bonding strength between the bases 11A, 11B.

(4) The foil-like brazing filler used in the table 2 of the fifth embodiment is easily handled. This facilitates the brazing, thus making it easy to fabricate the table 2. Further, the foil-like brazing filler is arranged in the joining interface so that it has a uniform thickness. This increases the joining strength of the joining interface and seals the joining interface. Accordingly, when the coolant water W flows in the water passage 12, the water W does not leak from the water passage 12. This maintains the cooling capability.

(5) The table 2 is formed by the silicon carbide bases 11A, 11B that have substantially equal thermal expansion coefficients. Thus, even if the table 2 is exposed to a high temperature, generation of thermal stress, which otherwise bends the table 2 as a whole, is suppressed. This prevents the table 2 from being flexed and increases the flatness of each wafer 5. As a result, the table 2 enables the diameter of each wafer 5 to be increased and improves the quality of the wafer 5.

(6) The heat conductivity TC1 of the upper base 11A is higher than the heat conductivity TC2 of the lower base 11B. Thus, heat is rapidly transmitted from the polishing surface 2*a* to the interior of the table 2 through the upper base 11A, which has the relatively high heat conductivity. The heat is thus transmitted to the coolant water W in the water passage 12. Accordingly, compared to the prior art in which the table 2 is mounted on the cooling jacket to indirectly cool the table 2, heat is efficiently released from the table 2. This reduces the temperature differences in the table 2. As described above, the heat uniformity of the table 2 is improved. The temperature of the table 2 is controlled relatively easily and accurately through the fluid supply. This contributes to increasing the diameter of each wafer 5 and improving the quality of the wafer 5.

The fifth embodiment may be modified as follows.

The brazing filler that joins the bases 11A, 11B together is not restricted to the brazing fillers containing silver as a main component like in the fifth embodiment. Other hard brazing fillers, such as gold brazing fillers, may be used as the brazing filler. However, in terms of cost, it is preferable to select a brazing filler that contains silver as a main component.

In the fifth embodiment, the upper base 11A is formed of a dense silicon carbide sinter, and the lower base 11B is formed of a porous silicon carbide sinter. However, the materials of the bases 11A, 11B are not restricted to this combination. Instead, for example, both the bases 11A, 11B may be formed of dense or porous silicon carbide sinters.

As shown in FIG. 5, the table 2 may have a triple layered structure that includes the bases 11A, 11B, and 11C. In this case, the heat conductivity TC1 of the base 11A is equal to or greater than the heat conductivity TC2 of the base 11B. Further, the heat conductivity TC2 of the base 11B is equal to or greater than the heat conductivity TC3 of the base 11C. That is, it is preferred that the following condition be satisfied: TC1≧TC2≧TC3. In addition, if the table 2 has four or more layers, a similar condition must be met.

Organic joining materials, such as epoxy resin adhesive agents, may replace the non-organic joining materials, such as the brazing fillers.

Sixth Embodiment

A sixth embodiment has the following improvement for further increasing the joining interface strength of the A type table 2 and the tables 2 of the second embodiment and its modifications (for the sake of brevity, these tables 2 are hereafter referred to as a B type table 2) when an organic joining material is employed.

Figure 13A:
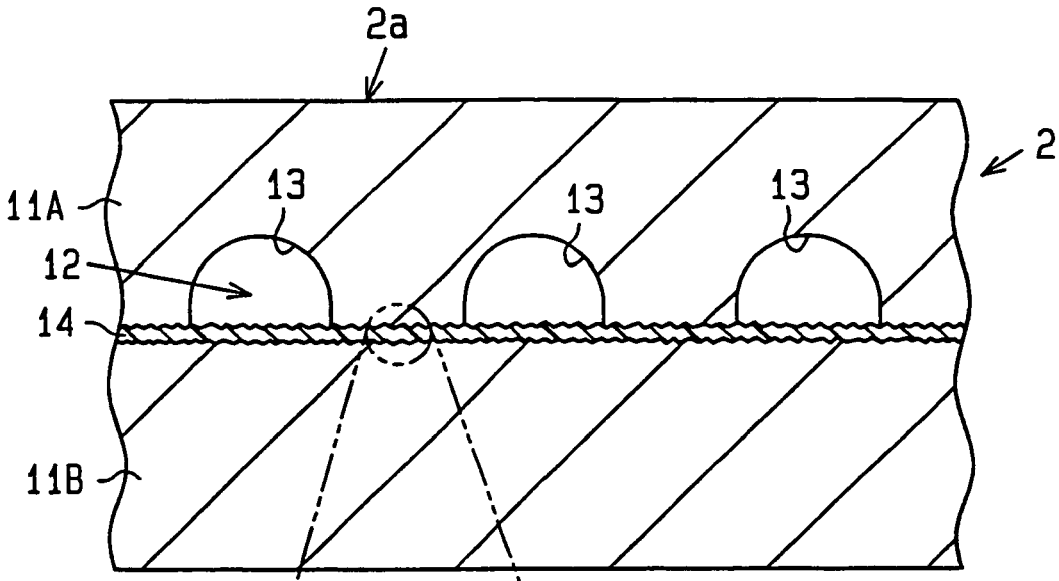
FIG. 13A is an enlarged cross-sectional view showing a main portion of a table used in an apparatus of a sixth embodiment according to the present invention.
Figure 13B:
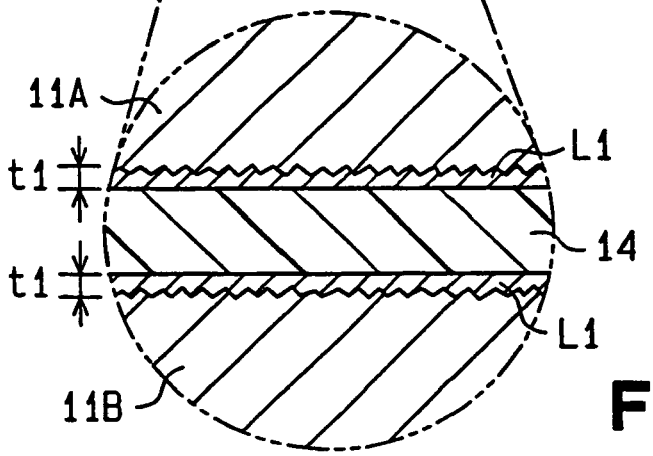
FIGS. 13B and 13C are further enlarged cross-sectional views each schematically showing an adhering interface of the table.

As shown in FIG. 13, in the sixth embodiment, the bases 11A, 11B are joined together by the organic adhesive agent layer 14. Particularly, in this embodiment, the organic adhesive agent layer 14 is formed from an epoxy resin type adhesive agent. More specifically, the adhesive agent of the adhesive agent layer 14 is formed from epoxy resin, transformed polyamine, and silicon oxide ($SiO_2$) that are mixed in accordance with a predetermined ratio. This adhesive agent has a preferable property in that it resists expansion when exposed to water. It is preferred that the adhesive agent has a thermosetting property. Also, the thickness of the adhesive agent layer 14 is preferred to be approximately 10–50 micrometers, and, is more preferred to be approximately 20–40 micrometers.

If the adhesive agent layer 14 is too thin, a sufficient adhesion strength cannot be obtained and the bases 11A, 11B easily separate from each other. Further, the modulus of elasticity of the organic adhesive agent is smaller than that of ceramic. Accordingly, if the thickness of the adhesive agent layer 14 is excessively large, cracking easily occurs in the adhesive agent layer 14 when stress is applied. In addition, the heat conductivity of the organic adhesive agent is smaller than that of ceramic. Thus, if the adhesive agent layer 14 is too thick, the heat resistance of the adhesive agent layer 14 increases and hinders the improvement of the heat uniformity of the table 2.

It is preferred that a processed modified layer L1 defined in a surface layer of the lower surface of the upper base 11A or the upper surface of the lower base 11B, which function as adhered surfaces, have a thickness of 30 micrometers or less. It is further preferred that the thickness be 10 micrometers or less, and particularly preferred that the thickness be one micrometer or less (see FIG. 13B). A surface exposing process performed after the calcinating step produces the processed modified layer L1, which has a thickness of approximately several tens of micrometers, in the surface layer of the bases 11A, 11B.

Figure 13C:
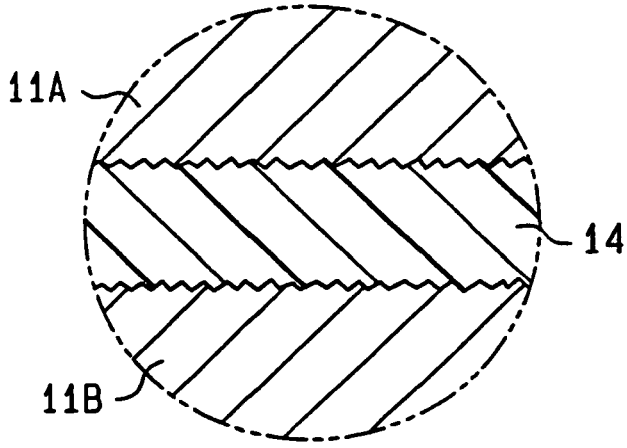
Figure 14:
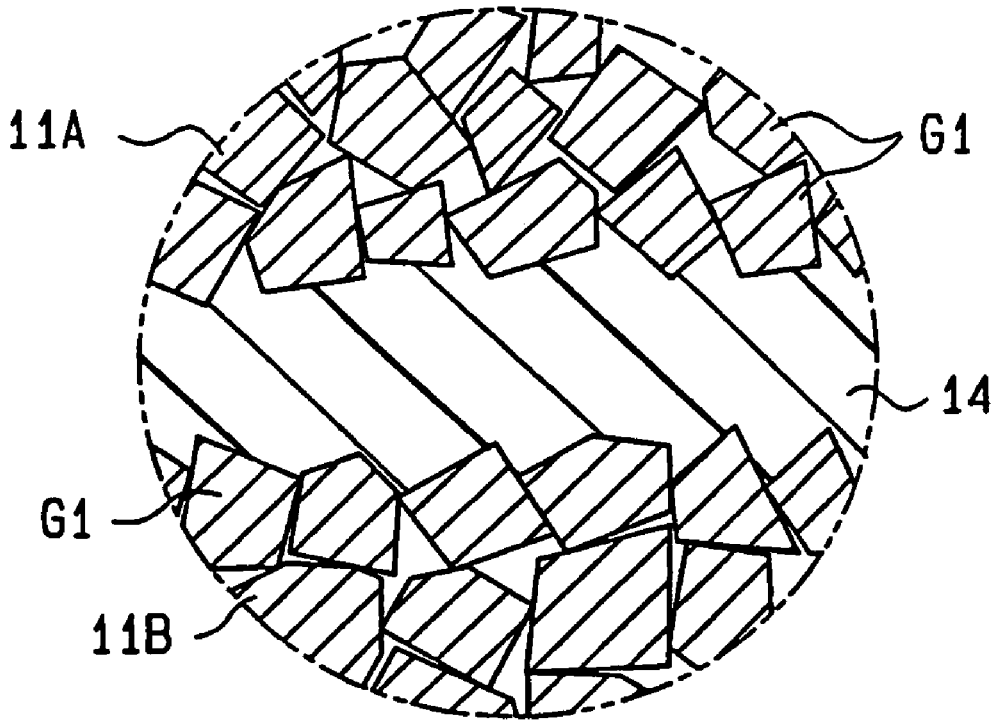
FIG. 14 is an enlarged cross-sectional view schematically showing crystal particles in the adhering interface of the table of the sixth embodiment.

If the organic adhesive agent is used and the thickness t1 of each zone L1 is greater than 30 micrometers, the processed modified layers L1 are likely to fall off and the adhering strength becomes insufficient. If possible, as shown in FIG. 13C, it is desirable that the processed modified layers L1 be completely removed. In this case, a grain boundary of crystal particles G1 is exposed from the surface layer of each base such that the adhesive agent layer 14 is embedded in the grain boundary, thus presumably ensuring an extremely high anchoring effect (see FIG. 14).

It is preferred that the surface roughness Ra of the lower side of the upper base 11A and the surface roughness Ra of the upper side of the lower base 11B be 0.01–2 micrometers, and is particularly preferred to be 0.1–1.0 micrometers. If the organic adhesive agent is used and Ra is included in the aforementioned ranges, a preferable anchoring effect is obtained in the surfaces of ceramic.

When Ra is less than 0.01 micrometers, the adhered surfaces of the bases 11A, 11B are smoothened such that there are no pits and lands. The organic adhesive agent thus cannot be embedded in the sintered ceramic bodies. In this case, the preferable anchoring effect cannot be obtained. Further, to make Ra less than 0.01 micrometers, a special process must be performed. This increases costs and lowers productivity. In addition, if Ra is greater than 2 micrometers, the preferable anchoring effect cannot be obtained.

A procedure for fabricating the table 2 will hereafter be described briefly.

First, like the first embodiment, disk-like molded products are molded with metal molds using silicon carbide powder as a starting material. The grooves 13 are ground in the lower side of a molded body that forms the upper base 11A. The body is then calcinated at 1800–2400 degrees Celsius. The bases 11A, 11B formed of sintered silicon carbide bodies are thus obtained.

After the calcination, a surface exposing process is performed to reduce (or completely remove) the processed modified layers L1 in the lower side of the upper base 11A and the upper side of the lower base 11B. Examples of a layer thinning process or a removal processes include a mechanical process such as a surface grinding using a grinder. A chemical process may be performed instead of the mechanical process. In the sixth embodiment, the chemical process is performed by etching with an acid etchant that melts silicon carbide. More specifically, the etching uses an etchant formed by adding a predetermined amount of weak acid to hydrofluoric-nitric acid. The weak acid includes organic acid such as acetic acid. The weight ratio of the component of hydrofluoric-nitric-acetic acid, or hydrofluoric acid:nitric acid:acetic acid, is preferably 1:2:1. As a result of the processing, the surface roughness Ra of the lower side of the upper base 11A and the upper side of the lower base 11B is adjusted and included in a range of 0.01–2 micrometers.

Subsequently, organic adhesive agent is applied to the upper side of the lower base 11B. The bases 11A, 11B are then superimposed. In this state, the bases 11A, 11B are heated to the hardening temperature of resin, thus adhering the bases 11A, 11B together. Finally, the upper side of the upper base 11A is polished to complete the table 2.

The followings are referential examples of the sixth embodiment.

Referential Example 6-1

In referential example 6-1, "beta random (trade name)", product of IBIDEN KABUSHIKI KAISHA, was used as silicon carbide powder that contained 94.6 weight percent of β type crystals.

First, 5 weight parts of polyvinyl alcohol and 300 weight parts of water were added to 100 weight parts of the silicon carbide powder. The mixture was then stirred in a ball mill for 5 hours to obtain a uniform mixture. The mixture was dried for a predetermined time to remove a certain amount of moisture from the mixture. An appropriate amount of the dry mixture was then sampled and granulated. Next, the granules of the dry mixture were molded with metal press dies at a pressure of 50 kg/cm$^2$.

The substantially entire lower side of a molded body that forms the upper base 11A was then ground to form the grooves 13 having a depth of 5 millimeters and a width of 10 millimeters.

Subsequently, the molded body was placed in a graphite crucible sealed from ambient air. The body was then calcinated using a Tammann type calcinating furnace. The calcination was performed in an argon gas atmosphere of one atmospheric pressure. During the calcination, the temperature was increased at a rate of 10 degrees Celsius per minute to a maximum temperature of 2300 degrees Celsius. The heat was maintained for two hours. The density of each resulting base 11A, 11B was 3.1 g/cm$^3$. The heat conductivity of each base 11A, 11B was 150 W/m·K.

Next, a surface exposing process was performed using a conventional method. Afterwards, surface grinding was performed as the layer thinning process. In this manner, the thickness t1 of the processed modified layer L1 of the lower side of the upper base 11A and that of the upper side of the lower base 11B were adjusted to be approximately one micrometer. Ra was included in the range of 0.01–2 micrometers. Subsequently, the bases 11A, 11B were integrally adhered to each other by an epoxy resin type adhesive agent ("EP-169", trade name, product of CEMEDINE). The thickness of the organic adhesive agent layer 14 was approximately 20 micrometers. The hardening temperature was 160 degrees Celsius, the hardening time was 90 minutes, and the load applied for adhesion was 10 g/cm$^2$.

Further, the upper side of the upper base 11A was polished to complete the table 2.

The resulting table 2 of referential example 6-1 was installed in the aforementioned various types of apparatuses 1. The semiconductor wafers 5 of different dimensions were then polished with the apparatuses 1, while constantly circulating the coolant water W. As a result, there were no thermal deformations in the table 2. Further, no cracks were found in the organic agent layer 14, and a high strength was maintained in the joining interface between the bases 11A, 11B. Also, a breakage test was conducted on the table 2 using a conventional method complying with JIS R 1624 to measure the bending strength of the interface. The result was approximately 10 kgf/mm$^2$. Further, there was no leakage of the coolant water W from the joining interface.

The observation of the semiconductor wafers 5 polished by the apparatuses 1 indicated that the wafers 5 were not damaged, regardless of the dimensions of the wafers 5. Further, no significant bending was noted in the wafers 5. In other words, it was apparent that the semiconductor wafers 5 produced by the table 2 of referential example 6-1 had an extremely high accuracy and high quality.

Referential Example 6-2

In referential example 6-2, a type silicon carbide powder (more specifically, "OY15 (trade name)", product of YAKUSHIMA DENKO KABUSHIKI KAISHA) was employed, instead of the β type. The density of each resulting base 11A, 11B was 3.1 g/cm$^3$. The heat conductivity of each base 11A, 11B was 125 W/m·K. Each base 11A, 11B contained 0.4 weight percent of boron and 1.8 weight percent of free carbon. Further, the surface exposing process and the surface grinding were performed to adjust the thickness t1 of the processed modified layer L1 of each adhering surface to approximately 5 micrometers. Ra was included in the range of 0.01–2 micrometers.

After producing the table 2 through the same procedure as referential example 6-1, the table 2 was installed in the various types of apparatuses 1 to polish the semiconductor wafers 5 of different dimensions. Accordingly, substantially the same advantageous results as those of referential example 6-1 were obtained. Further, no cracks were found in the organic adhesive agent layer 14, and the strength of the adhering interface between the bases 11A, 11B was high. The measurement of the bending strength under JIS R 1624 indicated that the average value of the bending strength was approximately 8 kgf/mm$^2$. In other words, referential example 6-2 with the starting material of α type silicon carbide powder was slightly improved in the adhering strength, as compared to referential example 6-1 with the starting material of β type silicon carbide powder.

Referential Examples 6-3, 6-4, 6-5

In these referential examples, the table 2 was produced basically through the same procedure as referential example 6-1. Further, in referential example 6-3, the thickness t1 of each machining modified zone L1 after the surface grinding was adjusted to approximately 10 micrometers. In referential example 6-44, the thickness t1 was adjusted to approximately 20 micrometers. In referential example 6-5, the thickness t1 was adjusted to be approximately zero micrometers (the processed modified layer L1 was completely removed). In both referential examples, Ra was included in the range of 0.01–2 micrometers.

The resulting table 2 was installed in the aforementioned various types of polishing apparatuses 1. The semiconductor wafers 5 of different dimensions were then polished. As a result, substantially the same advantageous effects as those of referential example 6-1 were obtained. Further, no cracks were noted in the organic adhesive agent layer 14, and the strength of the adhering interface between the bases 11A, 11B was high. The measurement of the bending strength under JIS R 1624 indicated that the averages of referential examples 6-3, 6-4, and 6-5 were approximately 7 kgf/mm$^2$, approximately 6 kgf/mm$^2$, and approximately 12 kgf/mm$^2$, respectively.

Referential Examples 6-6, 6-7

In referential example 6-6, the surface exposing process was performed after the calcination. However, the surface grinding, which would otherwise be performed after the surface exposing process, was not performed. The bases 11A, 11B were adhered together with the epoxy resin type adhesive agent "EP-160".

In referential example 6-7, the surface exposing process was performed after the calcination. However, the surface grinding, which would otherwise be performed after the surface forming machining, was not performed. The bases 11A, 11B were adhered together with an epoxy resin type adhesive agent ("CEMEDINE 100", trade name), which differs from the type used in the aforementioned referential examples. The thickness of the processed modified layer L1 of each adhering surface was approximately 35 micrometers and was much thicker than those of the aforementioned referential examples. Further, the value Ra of the adhering surface was 3.0 micrometers.

The measurement of the bending strength under JIS R 1624 was performed with the resulting table 2. The result indicated that the average values of referential examples 6-6 and 6-7 were approximately 4 kgf/mm$^2$ and approximately 1 kgf/mm$^2$, respectively. In other words, the adhering strength was not high like in referential examples 6-1, 6-2, 6-3, 6-4, and 6-5.

Conclusion

Accordingly, the sixth embodiment has the following effects.

(1) In the bases 11A, 11B of the table 2 of the sixth embodiment, the thickness t1 of the processed modified layer L1 of each adhering surface is 30 micrometers or less and Ra of each adhering surface is included in the range of 0.01 millimeters to 2 micrometers. Accordingly, even though the organic adhesive agent is used, the organic adhesive agent layer 14 has a sufficient strength. This suppresses cracking and peeling of the adhering interface. The table 2 is resists breakage and is practical. Further, the seal performance of the adhering interface is maintained to prevent the coolant water W in the water passage 12 from leaking from the adhering interface.

(2) In the sixth embodiment, the thickness of the organic adhesive agent layer 14 is selected from a range of 10–50 micrometers. This improves the heat uniformity of the table 2 and enables the adhering interface to have sufficient strength.

The sixth embodiment may be modified as follows.

Figure 15:
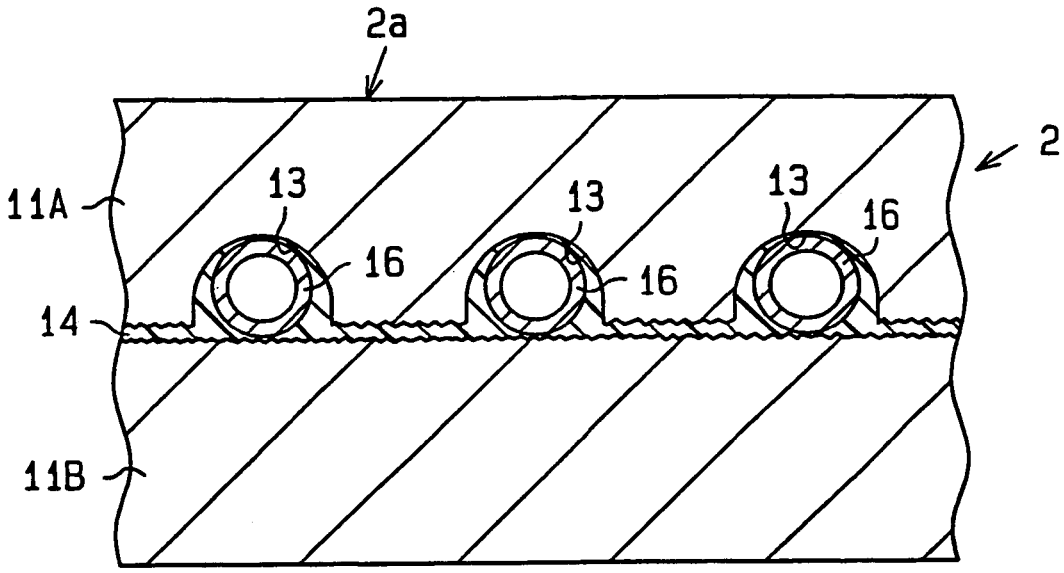
FIG. 15 is an enlarged cross-sectional view showing a main portion of a table according to a first modification of the sixth embodiment.

As shown in FIG. 15, the copper pipe 16 may be located in the grooves 13. Coolant water may be circulated through the copper pipe 16.

Figure 16:
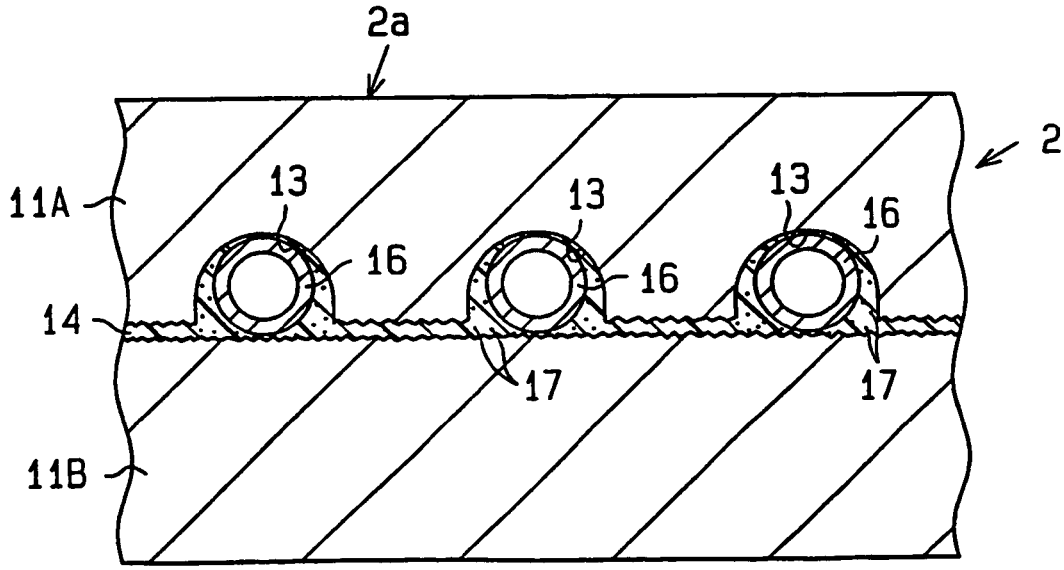
FIG. 16 is an enlarged cross-sectional view showing a main portion of a table according to a second modification of the sixth embodiment.

As shown in FIG. 16, the powder (for example, the copper powder) 17, which is formed from a substance having high heat conductivity, may be mixed as a filler in the organic adhesive agent 14 at least around the copper pipe 16.

The present invention is not restricted to the first to sixth embodiments but may be modified within the scope of the appended claims.

What is claimed is:

1. A table having a polishing surface for polishing a semiconductor wafer held by a wafer holding plate of a wafer polishing apparatus, wherein the table includes a plurality of superimposed bases, each base being formed from calcinated silicide ceramic or carbide ceramic, wherein the density of each base is at least 2.7 g/cm$^3$, and wherein at least one of the bases has a fluid passage formed in its superimposition interface.

2. A table having a polishing surface for polishing a semiconductor wafer held by a wafer holding plate of a wafer polishing apparatus, wherein the table includes a plurality of superimposed bases, each base being formed from a silicon carbide sinter, wherein the density of each base is at least 2.7 g/cm3, and wherein at least one of the bases has a fluid passage formed in its superimposition interface.

3. The table according to claim 1 or 2, wherein at least one base includes a groove formed in the superimposition interface and forming part of the fluid passage.

4. The table according to claim 1 or 2, further comprising a plurality of adhering layers for joining the bases.

5. The table according to claim 1 or 2, wherein at least one of the bases is arranged on an uppermost level of the superimposed bases and includes the polishing surface and a groove formed in a surface located on an opposite side of the polishing surface to form part of the fluid passage.

6. The table according to claim 5, wherein the groove has a depth that is ⅓ to ½ the thickness of the base.

7. The table according to claim 6, wherein the groove has a corner, the R of which is 0.3 to 5.

8. The table according to claim 7, wherein the groove is formed through machining before the base is formed through calcination.

9. The table according to claim 1 or 2, further comprising a brazing filler layer for joining the bases that contains titanium.

10. The table according to claim 9, wherein the brazing filler layer contains silver as a main component.

11. The table according to claim 10, wherein the content of titanium in the brazing filler layer is 0.1 weight percent to 10 weight percent.

12. The table according to claim 1 or 2, wherein the bases have substantially the same thermal expansion coefficients.

13. The table according to claim 12, wherein the thermal expansion coefficient of each of the bases is $8.0\times10^{-6}$/degrees Celsius or less.

14. The table according to claim 12, wherein the thermal expansion coefficient of each of the bases is $5.0\times10^{-6}$/degrees Celsius or less.

15. The table according to claim 14, wherein the difference of the thermal expansion coefficient between the base is $1.0\times10^{-6}$/degrees Celsius or less.

16. The table according to claim 1 or 2, wherein the heat conductivity of a first base located near the polishing surface is greater than or equal to that of a second base, which is in a level lower than the first base.

17. The table according to claim 16, wherein the first base is thinner than the second base.

18. The table according to claim 16, wherein the first base is a dense silicon carbide sinter, and the second base is a porous silicon carbide sinter.

19. The table according to claim 1 or 2, further comprising a plurality of organic adhesive agent layers for joining the bases, wherein a processed modified layer having a thickness of 30 micrometers or less is formed in a joining surface of the organic adhesive agent layer in each of the bases.

20. The table according to claim 19, wherein each of the organic adhesive agent layers has a thickness of 10 micrometers to 50 micrometers.

21. The table according to claim 1 or 2, further comprising a plurality of organic adhesive agent layers for joining the bases, wherein the surface roughness (Ra) of a joining surface of the organic adhesive agent layer in each of the bases is 0.01 micrometers to 2 micrometers.

22. The table according to claim 21, wherein each of the organic adhesive agent layers has a thickness of 10 micrometers to 50 micrometers.

23. The table according to claim 1, wherein the heat conductivity of each base is at least 30 W/mK or greater.

24. The table according to claim 23, wherein at least one base includes a groove formed in the superimposition interface and forming part of the fluid passage, and the table further includes a pipe located in the groove and formed from a high heat conductivity material.

25. The table according to claim 24, wherein the groove has a round cross-sectional form.

26. The table according to claim 24, wherein the adhering layers at least around the pipe contain powder formed of a high heat conductivity substance.

27. The table according to claim 26, wherein the powder is copper powder, and the pipe is a curved copper pipe.

28. The table according to claim 1, wherein the Young's modulus of each of the bases is at least 1.0 $kg/cm^2(\times10^6)$ or greater.

29. The table according to claim 2, wherein the Young's modulus of each base is 1.0 to 5.0 $kg/cm^2(\times10^6)$.

30. The table according to claim 1, wherein the fluid passage is a water passage.

31. The table according to claim 1, wherein the at least one of the bases has a through hole communicated with the fluid passage.

32. The table according to claim 1, wherein the ceramic contains β type silicon carbide powder.

33. The table according to claim 1, wherein the plurality of superimposed bases are formed through calcination at at least 1800 degree.

34. The table according to claim 2, wherein the fluid passage is a water passage.

35. The table according to claim 2, wherein the at least one of the bases has a through hole communicated with the fluid passage.

36. The table according to claim 2, wherein the ceramic contains β type silicon carbide powder.

37. The table according to claim 2, wherein the plurality of superimposed bases are formed through calcination of at least 1800 degree.

* * * * *